US010520183B2

(12) United States Patent
Tomita

(10) Patent No.: US 10,520,183 B2
(45) Date of Patent: Dec. 31, 2019

(54) WAIST MOUNTED LIGHT APPARATUS

(71) Applicant: Paul Kenji Tomita, Mill Valley, CA (US)

(72) Inventor: Paul Kenji Tomita, Mill Valley, CA (US)

(73) Assignee: Light-Belt LLC, Mill Valley, CA (US)

( * ) Notice: Subject to any disclaimer, the term of this patent is extended or adjusted under 35 U.S.C. 154(b) by 0 days.

(21) Appl. No.: 16/182,386

(22) Filed: Nov. 6, 2018

(65) Prior Publication Data

US 2019/0072268 A1 Mar. 7, 2019

Related U.S. Application Data

(63) Continuation-in-part of application No. 15/823,350, filed on Nov. 27, 2017, now abandoned.

(60) Provisional application No. 62/745,055, filed on Oct. 12, 2018, provisional application No. 62/427,036, filed on Nov. 28, 2016.

(51) Int. Cl.

| | |
|---|---|
| ***F21V 33/00*** | (2006.01) |
| ***A41F 9/00*** | (2006.01) |
| ***F21V 23/02*** | (2006.01) |
| ***F21V 21/08*** | (2006.01) |
| ***F21V 21/14*** | (2006.01) |
| *A41D 27/20* | (2006.01) |

(52) U.S. Cl.

CPC ..... *F21V 33/0008* (2013.01); *A41F 9/002* (2013.01); *F21V 21/0816* (2013.01); *F21V 21/145* (2013.01); *F21V 23/023* (2013.01); *A41D 27/205* (2013.01)

(58) Field of Classification Search

CPC .. F21V 33/0008; F21V 23/023; F21V 21/145; F21V 21/0816; A41F 9/002; A41D 27/205

See application file for complete search history.

(56) References Cited

U.S. PATENT DOCUMENTS

| | | | |
|---|---|---|---|
| D691,795 | S | 10/2013 | Do |
| D738,618 | S | 9/2015 | Do |
| 2013/0048687 | A1 | 2/2013 | Do |
| 2013/0048695 | A1 | 2/2013 | Do |
| 2016/0051035 | A1 | 2/2016 | Do |
| 2018/0295972 | A1 | 10/2018 | Do |

*Primary Examiner* — Sonji N Johnson

(74) *Attorney, Agent, or Firm* — Staniford Tomita LLP; Paul K. Tomita

(57) ABSTRACT

A tubular belt includes an inner layer and an outer layer that are coupled together at an upper edge and a lower edge. A flat tubular storage pocket space is formed between the inner and the outer layers. The pocket can be accessed through one or more pocket openings formed in the outer layer. A light coupling can be attached to the elastic belt to securely hold a light to the elastic belt. The light coupling mechanism extends outward from a pocket of the belt and a light is attached to the light coupling mechanism.

20 Claims, 44 Drawing Sheets

FIG. 8
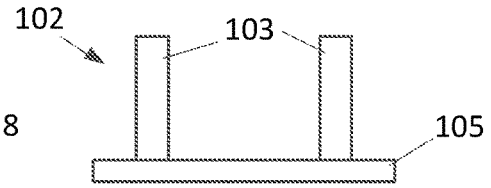
FIG. 9
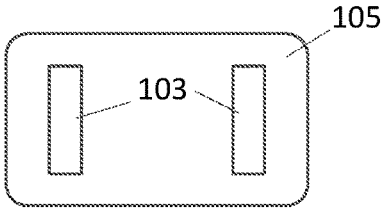
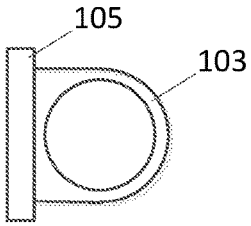
FIG. 10
FIG. 11
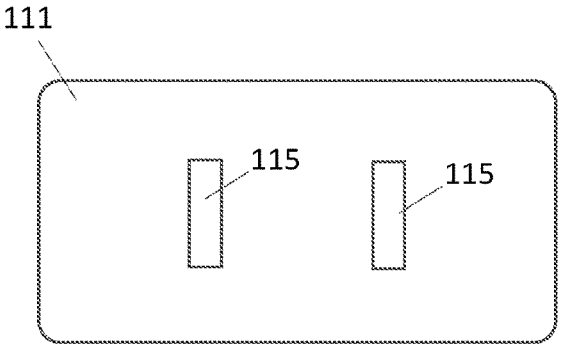
FIG. 12
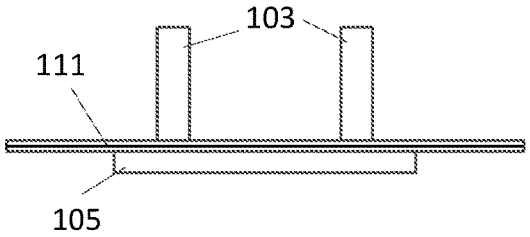
FIG. 13
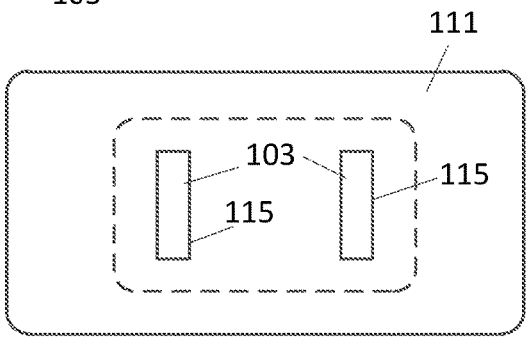
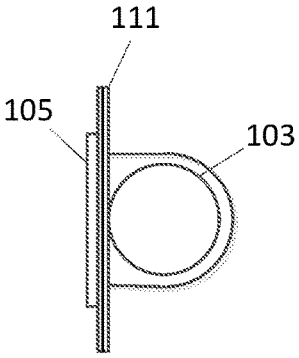
FIG. 14

FIG. 15
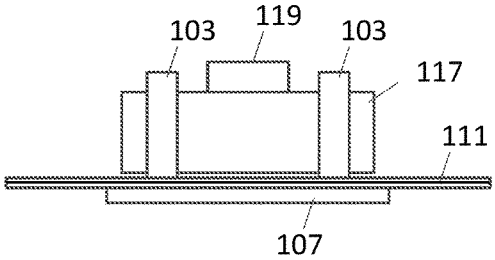
FIG. 16
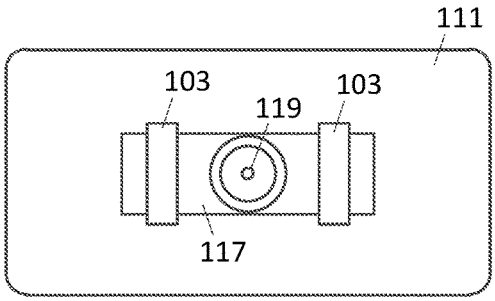
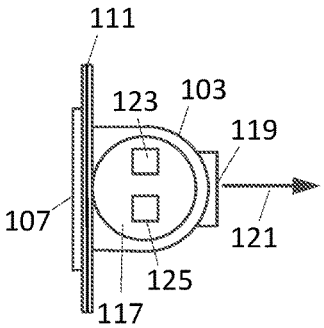
FIG. 17
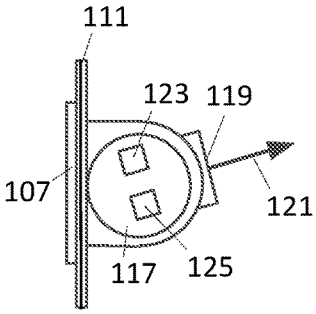
FIG. 18
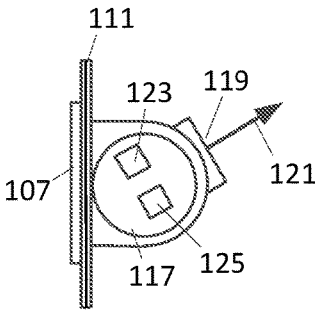
FIG. 19
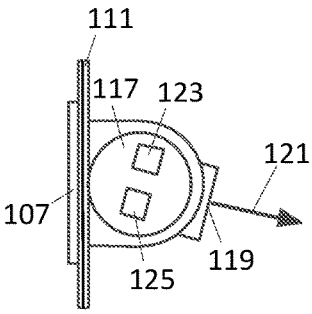
FIG. 20
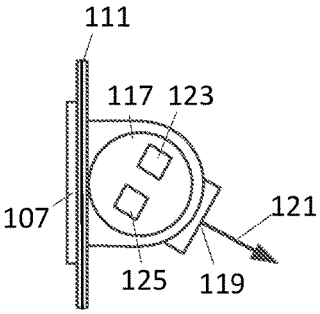
FIG. 21

FIG. 35
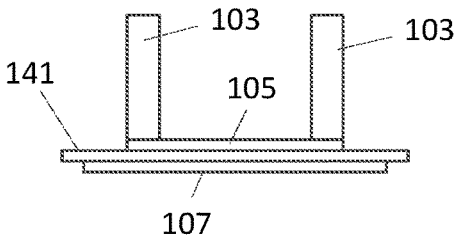
FIG. 36
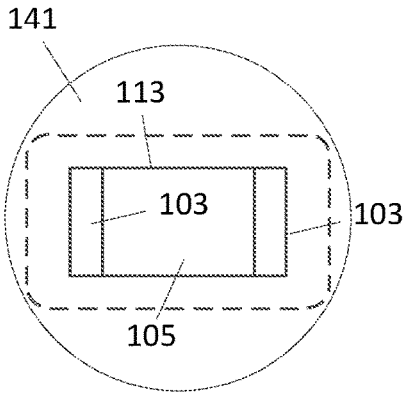
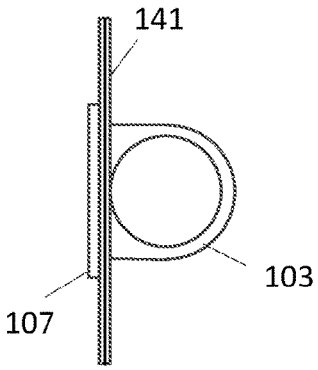
FIG. 37

FIG. 51
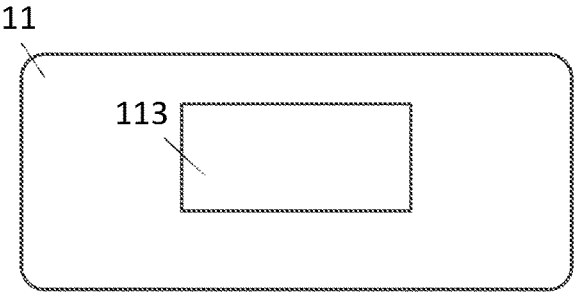
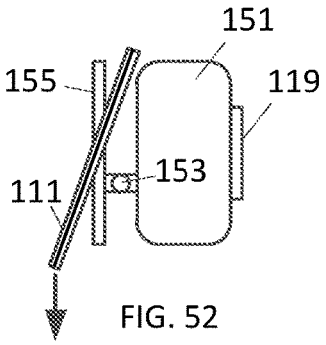
FIG. 52
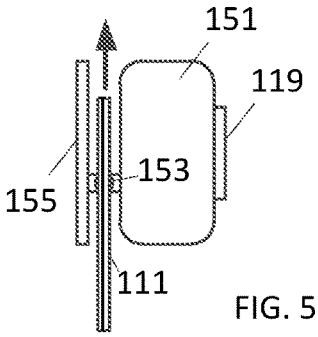
FIG. 53
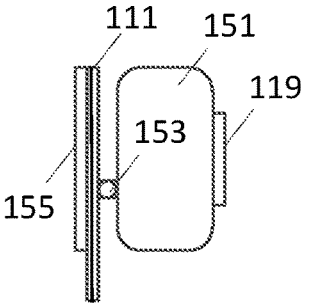
FIG. 54
FIG. 55
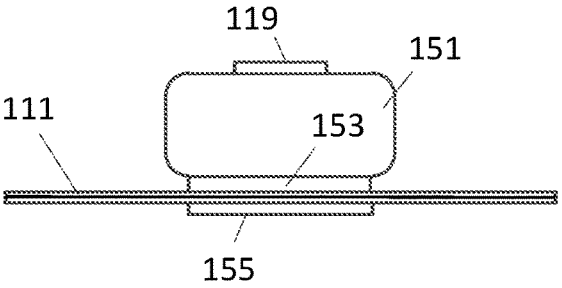
FIG. 56
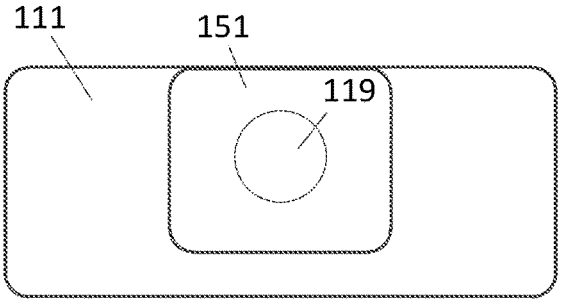

FIG. 80
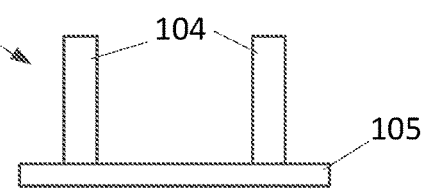
FIG. 81
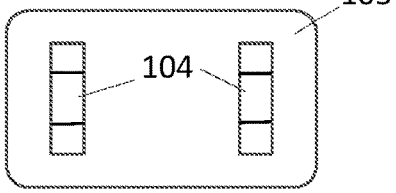
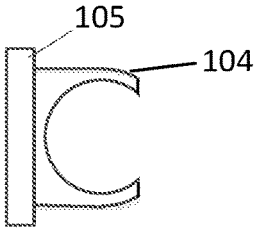
FIG. 82
FIG. 83
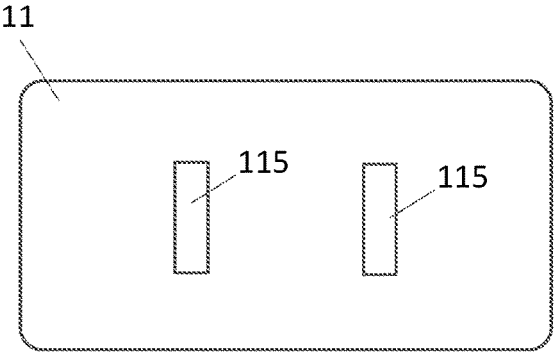
FIG. 84
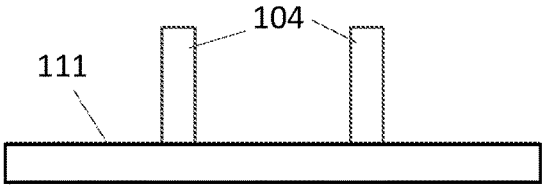
FIG. 85
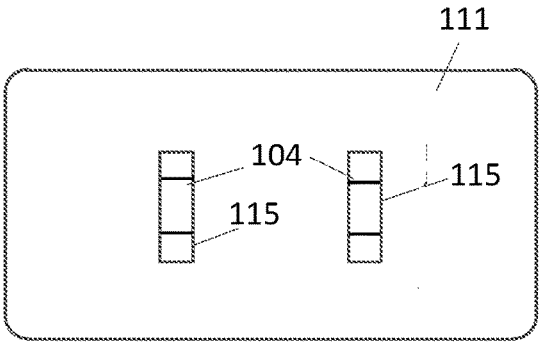
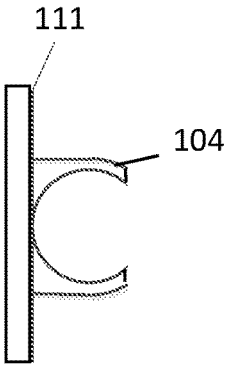
FIG. 86

FIG. 106
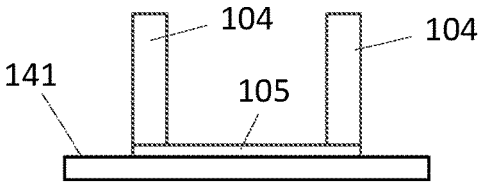
FIG. 107
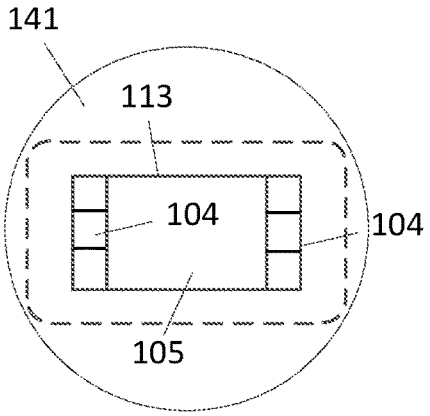
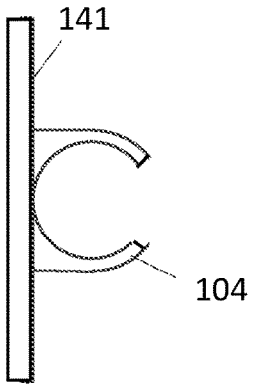
FIG. 108

WAIST MOUNTED LIGHT APPARATUS

CROSS REFERENCE TO RELATED APPLICATIONS

This application claims priority to U.S. Provisional patent Application No. 62/745,055, "Waist Mounted Light Holder Apparatus" filed Oct. 12, 2018, and is a continuation in part of U.S. patent application Ser. No. 15/823,350, "Waist Mounted Light Holder Apparatus" filed Nov. 27, 2017, now U.S. Pat. No. now abandoned which claims priority to U.S. Provisional patent Application No. 62/427,036, "Light Mounts Coupled To Belt Pockets" filed Nov. 28, 2016. US Patent Application Nos. 62/427,036, 62/745,055, and Ser. No. 15/823,350 are hereby incorporated by reference in their entirety.

BACKGROUND

Running accessories include storage systems for carrying personal items such as: mobile phones, keys, identification, money and other small personal items. These storage system include back packs, waist packs and vests. If running is done at night, lights are needed so that the runner can see where he or she is stepping. Flashlights are well known hand held devices. However, flashlights must be held and pointed at the area where the runner will be running which can alter the runner's form. Lights have also been attached to straps that hold the lights to the head of the user and belts worn around the waist of the user. What is needed is an improved system and method for attaching lights to elastic tubular belts with pockets.

BRIEF DESCRIPTION OF THE DRAWINGS

FIG. 8 illustrates a top view of an embodiment of a light holder.

FIG. 9 illustrates a front view of an embodiment of a light holder.

FIG. 10 illustrates a side view of an embodiment of a light holder.

FIG. 11 illustrates a front view of an embodiment of a light holder mount.

FIG. 12 illustrates a top view of an embodiment of a light holder in a light holder mount.

FIG. 13 illustrates a front view of an embodiment of a light holder in a light holder mount.

FIG. 14 illustrates a side view of an embodiment of a light holder in a light holder mount.

FIG. 15 illustrates a top view of an embodiment of a light in a light holder in a light holder mount.

FIG. 16 illustrates a front view of an embodiment of a light in a light holder in a light holder mount.

FIG. 17 illustrates a side view of an embodiment of a light in a light holder in a light holder mount.

FIGS. 18 and 19 illustrate a side view of an embodiment of a light rotated up in a light holder in a light holder mount.

FIGS. 20 and 21 illustrate a side view of an embodiment of a light rotated down in a light holder in a light holder mount.

FIG. 35 illustrates a top view of an embodiment of a light holder in a light holder mount.

FIG. 36 illustrates a side view of an embodiment of a light holder in a light holder mount.

FIG. 37 illustrates a front view of an embodiment of a light holder in a light holder mount.

FIG. 51 illustrates a front view of an embodiment of a light holder mount.

FIGS. 52, 53 and 54 illustrate side views of an embodiment of a light holder mount placed on a light holder.

FIG. 55 illustrates a top view of an embodiment of a light holder mount placed on a light holder.

FIG. 56 illustrates a front view of an embodiment of a light holder mount placed on a light holder.

FIG. 80 illustrates a top view of an embodiment of a light holder.

FIG. 81 illustrates a front view of an embodiment of a light holder.

FIG. 82 illustrates a side view of an embodiment of a light holder.

FIG. 83 illustrates a front view of an embodiment of a light holder mount.

FIG. 84 illustrates a top view of an embodiment of a light holder in a light holder mount.

FIG. 85 illustrates a front view of an embodiment of a light holder in a light holder mount.

FIG. 86 illustrates a side view of an embodiment of a light holder in a light holder mount.

FIG. 106 illustrates a top view of an embodiment of a light holder in a light holder mount.

FIG. 107 illustrates a side view of an embodiment of a light holder in a light holder mount.

FIG. 108 illustrates a front view of an embodiment of a light holder in a light holder mount.

FIG. 141 is a perspective front of a belt with a light in a light holder attachment and a connected buckle.

FIG. 142 is a perspective front shown of a belt with a light in a light holder attachment and a connected buckle.

DETAILED DESCRIPTION

Figure 1:
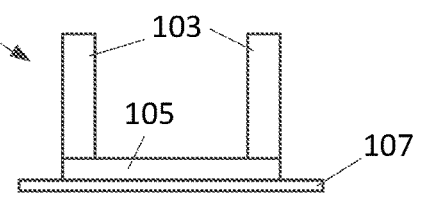
FIG. 1 illustrates a top view of an embodiment of a light holder.

Belt storage systems have been developed that allow people to carry personal items around their waist. An example of a tubular belts that include storage areas include: FlipBelt and Nathan Hipster. The tubular belt can include an inner layer and an outer layer that are coupled together at an upper edge and a lower edge. A flat tubular pocket can be formed in the space between the inner and the outer layers within the tubular belt. The pocket can be accessed through one or more openings formed in the outer layer or the inner layer of the belt. In an embodiment, these openings can be horizontal linear slots in the closed position formed in the outer layer that can be parallel with the upper and lower edges. The slots can be expanded and objects can be placed through the expanded slot openings. When an items is placed in a pocket, the outer layer can compress the items against the inner layer to securely hold the items in the pocket. The inner and outer layers can be made of an elastic material so that the entire belt can be in length expanded to be placed on the waist or hips of the wearer. The elastic materials of the belt can stretch the belt in circumference which can hold the belt in the desired position on the waist or hips of the wearer.

It can be desirable to have objects secured to the belt that extend from outward from a pocket of the belt. The user to operate controls of the coupled objects. For example, in an embodiment, a light can be attached to the belt with a light coupling mechanism that is attached to a pocket of the belt and a light holder portion that extends outward from the pocket of the belt.

The pocket portion of the coupling mechanism can be securely held within the pocket. In an embodiment, the pocket portion can include a flexible sheet of material that has a height that closely matches the height of the pocket. For example, if the pocket is 2.5 inches in height from the lower to upper edge, the height of the pocket portion can also be 2.5 about in height. In an embodiment, the pocket portion can be a flexible sheet of high strength material that can be inserted into the pocket through one of the slots. In an embodiment, the insert portion can be a thin flexible plastic material such as polycarbonate that can be 0.003-0.010 inch thick. The insert portion can flex with the inner surface forming a concave inner surface that is adjacent to and in direct physical contact with the inner layer of the belt and an outer convex surface that is adjacent to and in direct physical contact with the outer layer of the belt. The insert portion can conform to match the shape of the belt when worn by a user.

The light holder portion of the coupling mechanism can extend from one of the pocket slots of the belt. In an embodiment, the coupling mechanism can be a light holder that secure a light device to the belt. The light holder portion can include two elastic bands which surround the light mechanism. The light mechanism can include a cylindrical housing that is an elongated structure that defines a center axis. The cylindrical housing can hold one or more batteries, which are aligned with the cylindrical housing. For example, the battery can be a cylindrical structure such as an AA, AAA, 18650 or other type of rechargeable or disposable battery that fits within the cylindrical housing. The light mechanism can include a light output such as a high efficiency high output light emitting diode (LED). The light output can have an output greater than 300-500 lumens. The light output can be positioned on the housing to transmit light in a direction that is perpendicular to the center axis of the housing or a direction that is parallel to the center axis of the housing. In an embodiment, the light mechanism can be mounted in the center of the housing and in other embodiments, the light can be mounted on an end portion of the housing. When the light mechanism is mounted in the elastic bands and the belt is worn by a user, the angle of the light can be adjusted by rotating the light mechanism within the elastic bands.

Figure 2:
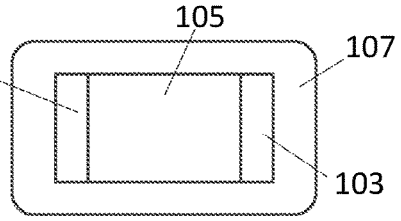
FIG. 2 illustrates a front view of an embodiment of a light holder.
Figure 3:
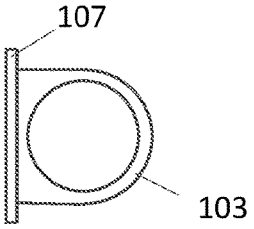
FIG. 3 illustrates a side view of an embodiment of a light holder.

FIGS. 1-3 illustrate a first embodiment of a light holder 101 that includes a base 105 that is coupled to a flange 107 and loops 103 that are perpendicular to the base 105. The base 105 can be rectangular in shape. The flange 107 can also be rectangular in shape and extend outward from the perimeter of the base 105. The loops 103 can include a circular inner diameter. The light holder 101 can be made of a homogeneous elastic material such as rubber.

Figure 4:
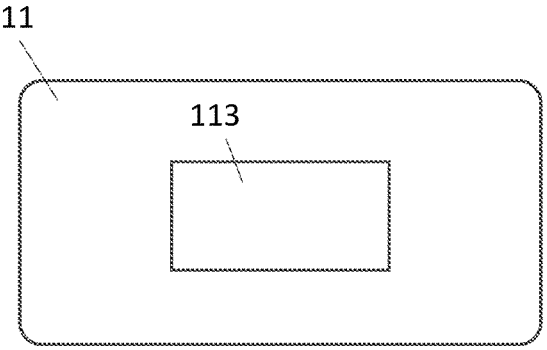
FIG. 4 illustrates a front view of an embodiment of a light holder mount.

FIG. 4 illustrates an embodiment of a light holder mount 111 which can include a thin flexible plastic material layer alone or in combination with one foam layer attached to one side of the plastic layer or two foam layers attached to opposite sides of the plastic layer. In an embodiment, the light holder mount 111 can include an inner foam layer attached to the thin plastic material layer or both an inner foam layer and an outer foam layer that are both attached to the thin flexible plastic material layer. The inner and/or outer foam layers can be flexible and provides a friction surface that resists sliding when the light holder mount 111 is placed in a pocket of a belt. The foam layers can also provide cushioning against the outer surfaces of the flexible plastic material layer. The light holder mount 111 can be oval, rectangular or any other suitable shape. The light holder mount 111 can include a center hole 113 which can be rectangular hole or other suitable shape in a center portion of the light holder mount 111. The rectangular hole 113 in a center portion can be symmetrically positioned or located at the geometric center of the light holder mount 111. The thin plastic material can be flexible in bending, but inelastic in tension so that the light holder mount 111 can easily bend, but the inner rectangular hole 113 cannot expand. Thus, a light holder can be securely held within the hold 113 of the light holder mount 111.

The rectangular hole 113 can be approximately the same shape as the base of the light holder shown in FIGS. 1-3. The rectangular hole 113 can be centered within the light holder mount 111. The rectangular hole 113 can be slightly larger than the base of the light holder in width and height. For example, the width of the hole 113 can be X and the height of the hole 113 can be Y. The width of the rectangular hole 113 can be X=width of the base of the light holder+0.2 inch or less and the length of the rectangular hole 113 can be Y=height of the base of the light holder+0.1 or less. In some embodiments, the base of the light holder can be made of an elastic material and the dimensions of the rectangular hole 113 can be equal to or slightly smaller than the width and height of the base of the light holder. In a preferred embodiment, the thickness of the light holder mount 111 can be 0.40 inch thick or less. The outer corners of the light holder mount 111 can be rounded so that the light holder mount 111 can easily slide through pockets into the belt.

Figure 5:
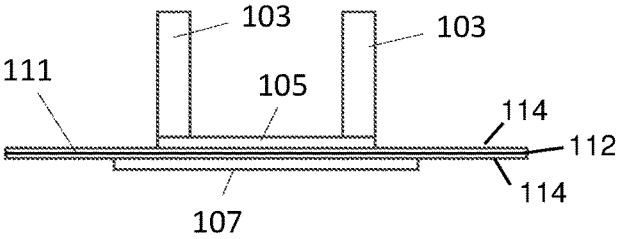
FIG. 5 illustrates a top view of an embodiment of a light holder in a light holder mount.
Figure 6:
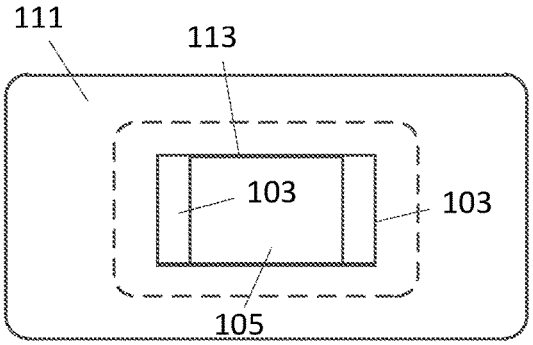
FIG. 6 illustrates a front view of an embodiment of a light holder in a light holder mount.
Figure 7:
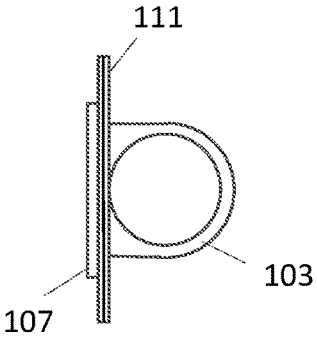
FIG. 7 illustrates a side view of an embodiment of a light holder in a light holder mount.

FIGS. 5-7 illustrate the light holder 101 installed in the hole 113 of the light holder mount 111. In the illustrated embodiment the light holder mount 111 can have a plastic layer 112 and an inner foam layer 114 and an outer foam layer 114. In an embodiment the plastic layer 112 can be 0.005-0.050 inch thick polycarbonate or any other suitable plastic material and the foam can be 0.050-0.200 inch thick ethylene vinyl acetate (EVA) foam or any other suitable plastic material. The inner foam layer 114 and outer foam layer 114 can be attached to the plastic layer 112 with an adhesive. The inner surfaces of the hole 113 can surround the base 105. The loops 103 can be positioned on one (outer) side of the light holder mount 111 and the flange 107 can be positioned on the opposite (inner) side of the light holder mount 111. The flange 107 can prevent the light holder 101 from being pulled out forward from the light holder mount 111. While the light holder 101 and the light holder mount 111 have been illustrated as separate components, in some embodiments, the light holder mount 111 and light holder 101 can be integrated into a single structure.

FIGS. 8-10 illustrate an embodiment of a second embodiment of a light holder 102 that includes a base 105 and loops 103 that are perpendicular to the base 105. The base 107 can be rectangular in shape. The loops 103 can include a circular inner diameter. The light holder 102 can be made of a homogeneous elastic material such as rubber.

FIG. 11 illustrates an embodiment of a light holder mount 111 which can include a thin flexible plastic material. The light holder mount 111 can be oval, rectangular or any other suitable shape and can include two rectangular loop holes 115 in a center portion. In a preferred embodiment, the thickness of the belt insert 111 can be 0.10 inch thick.

FIGS. 12-14 illustrate the light holder 101 installed in the holes 115 of the light holder mount 111. The inner surfaces of the holes 115 can surround the base of the loops 103. The loops 103 can be positioned on one (outer) side of the light holder mount 111 and the base 105 can be positioned on the opposite (inner) side of the light holder mount 111. The base 105 can prevent the light holder 102 from being pulled out of the insert 111. While the light holder 101 and the light holder mount 111 have been illustrated as separate components, in some embodiments, the light holder mount 111 and light holder 101 can be integrated into a single structure.

FIGS. 15-17 illustrate a light 119 coupled to an elongated housing 117. In this example, the elongated housing 117 can be partially or completely cylindrical in shape and the light 119 can be mounted on a center portion of the housing 117. A battery such as a rechargeable battery can be placed within the housing 117 and the light can be a high efficiency light emitting diode or any other suitable light source. The light 119 can emit a beam 121 that is substantially perpendicular to the center axis of the housing 117. The ends of the housing 117 on either side of the light 119 can be placed in the loops 103. The housing 117 can include a charging port 123 and a control switch 125. The length of the housing 117 can be greater than length of the hole 113 in the light holder mount 111. When the switch 125 is pressed, the light 119 is illuminated and emits a light beam 121. With reference to FIGS. 18-21, the housing 117 can be rotated within the loops 103 to change the angular position of the light beam 121. With reference to FIGS. 18 and 19, the light housing 117 and light beam 121 are rotated upward. With reference to FIGS. 20 and 21, the light housing 117 and light beam 121 are rotated downward.

Figure 22:
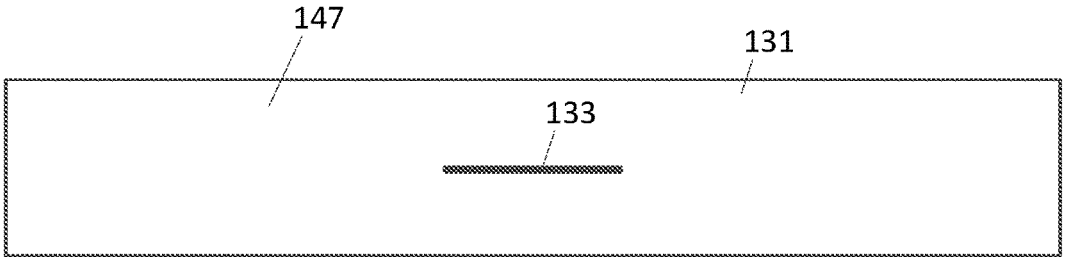
FIG. 22 illustrates a front view of an embodiment of an elastic belt.
Figure 23:
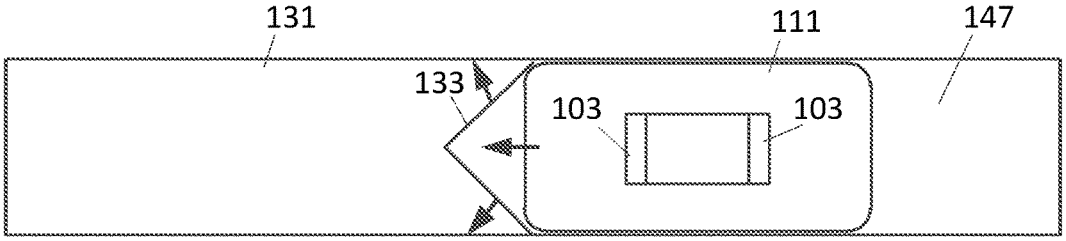
FIGS. 23, 24, 25 and 26 illustrates a front view of an embodiment of a light holder in a light holder mount placed into a pocket opening in an elastic belt.
Figure 24:
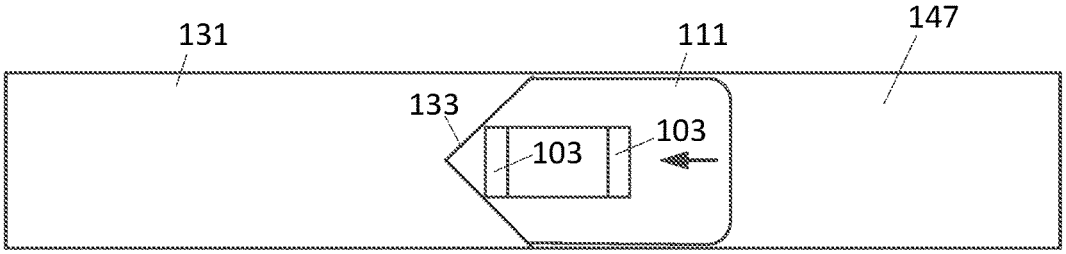
Figure 25:
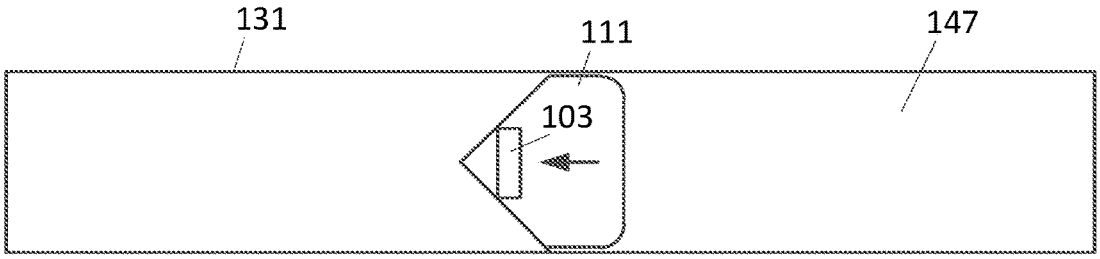
Figure 26:
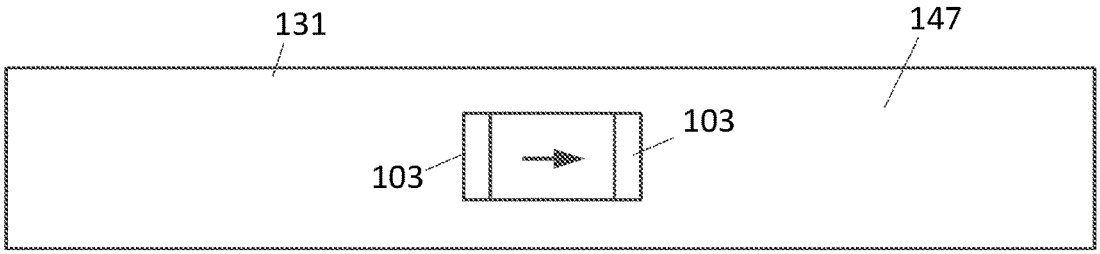

An embodiment of a method for installing the light holder and light holder mount 111 is illustrated in FIGS. 22-27. With reference to FIG. 22, a front view of an elastic tubular belt 131 is illustrated. The outer layer 147 of a belt 131 can have a slot pocket 133 that is parallel to the upper and lower edges of the belt 131. With reference to FIG. 23, the slot pocket 133 is opened by widening the pocket 133 to a width that is greater than the width of the light holder mount 111. The width of the light holder mount 111 can be equal to or slightly narrower or wider than the width of the tubular belt pocket. With reference to FIG. 24, a first edge of the light holder mount 111 is slid into the slot pocket 133. Because the loop 103 is made of rubber, it can be bent towards the plane of the light holder mount 111 and the loop 103 can be inserted into the belt 131. With reference to FIG. 26, the entire light holder mount 111 has been placed into the belt 131. The light holder mount 111 is slid back in the opposite direction so that both loops 103 extend out of the slot pocket 133. The light holder mount 111 is held in a stable vertical position by the upper and lower edges of the internal belt pocket. The loops 103 are also held vertically and horizontally by the inner surfaces of the slot pocket 133.

In other embodiments, the light holder mount 111 can be inserted into the slot pocket 133 without having to place either of the loops 103 into the slot pocket 133. More specifically, the slot pocket 133 can be stretched around the perimeter of the light holder mount 111 without having to insert a loop 103 into the slot pocket 133. In these embodiments, the light holder mount 111 sequence can go from FIG. 24 to FIG. 26 without inserting either of the loops 103 into the slot pocket 133.

Figure 27:
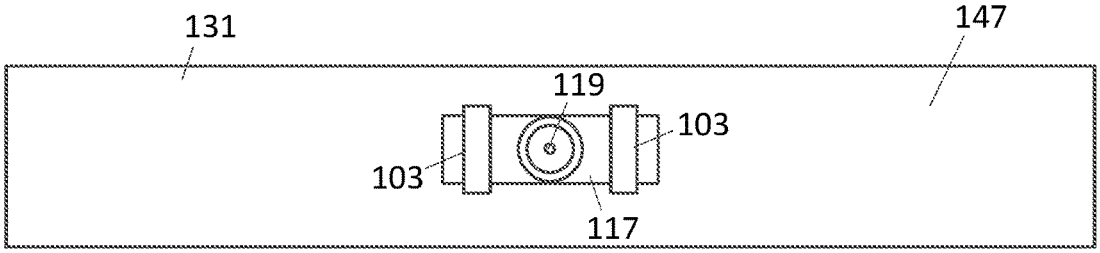
FIG. 27 illustrates a front view of an embodiment of a light placed in a light holder in a light holder mount placed into a pocket opening in an elastic belt.

With reference to FIG. 27, the light housing 107 is placed within the loops 103 with the light 119 facing outward from the belt 131. The opposite procedure or steps can be performed to remove the light holder mount 111 from the belt 131. The removal can be useful if the user needs to remove all attachments to wash the belt 131.

Figure 28:
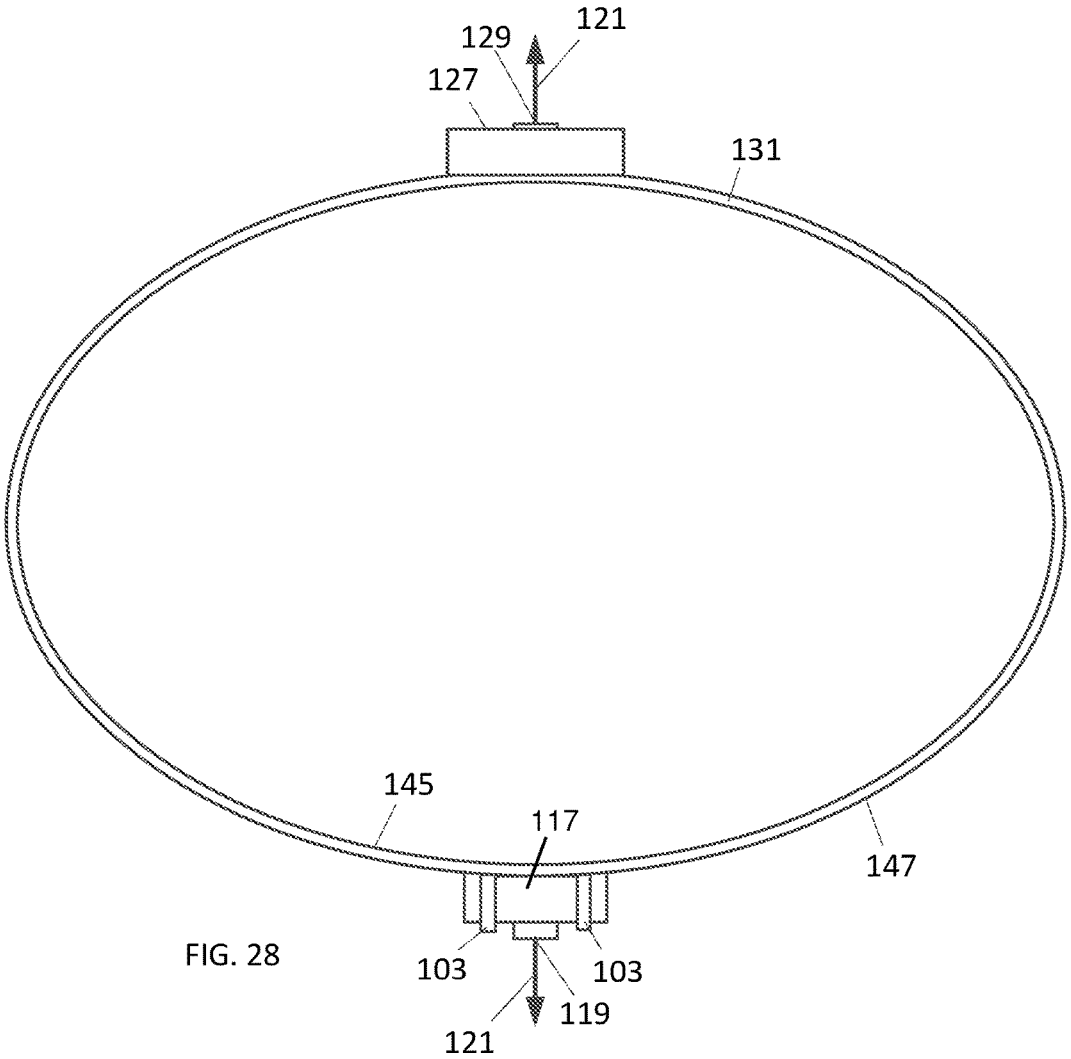
FIG. 28 illustrates a top view of an embodiment of a front light placed in a light holder in a light holder mount placed into a pocket opening in an elastic belt and a rear light attached to the elastic belt.
Figure 29:
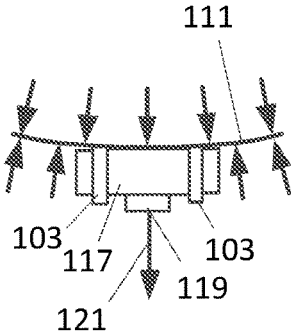
FIG. 29 illustrates a top view of an embodiment of a front light placed in a light holder in an arched light holder mount.
Figure 30:
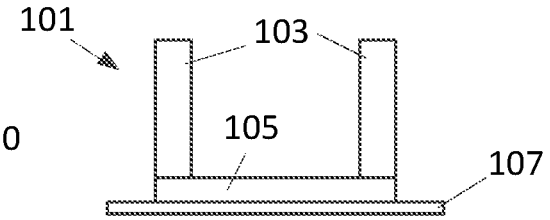
FIG. 30 illustrates a top view of an embodiment of a light holder.
Figure 31:
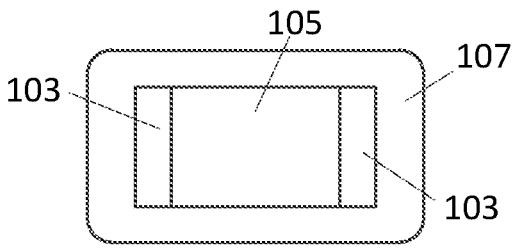
FIG. 31 illustrates a front view of an embodiment of a light holder.
Figure 33:
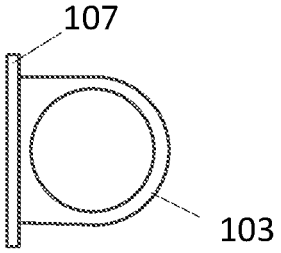
FIG. 33 illustrates a side view of an embodiment of a light holder.

A top view of the assembled light holder and belt insert is illustrated in FIG. 28. In this embodiment, the light 119 is facing away from the front of the belt 131 and a second rear light 129 is facing away from the rear of the belt 131. The second rear light 129 can be attached to a battery pack 127 which can be used to power the lights in the belt. The belt 131 can be made with an inner layer 145 and an outer layer 147 forming a tubular structure. With reference to FIG. 29, the light holder mount 111 can be compressed between the inner layer 145 and the outer layer 147. More specifically, the user's waist may exert an outward force on the light holder mount 111 and the outer layer 147 may exert a compressive force inward against the light holder mount 111. The compression of the light holder mount 111 can help to hold the light holder mount 111 in place and hold the light 117 in a steady position on the belt 131. The light holder mount 111 can bend to match the curvature of the belt 131. The bending of the light holder mount 111 can cause this structure to rigid in vertical compression and resist vertical forces on the upper and lower edges of the light holder mount 111. In contrast, the light holder mount 111 can be flexible in response to horizontal forces.

With reference to FIGS. 30-37, in another embodiment the light holder 101 can be used with an oval or a circular light holder mount 141. FIGS. 30-33 illustrate a first embodiment of a light holder 101 that includes a base 105 that is coupled to a flange 107 and loops 103 that are perpendicular to the base 105. The base 105 can be rectangular in shape. The flange 107 can also be rectangular in shape and extend outward from the perimeter of the base 105. The loops 103 can include a circular inner diameter. The light holder 101 can be made of a homogeneous elastic material such as rubber.

Figure 34:
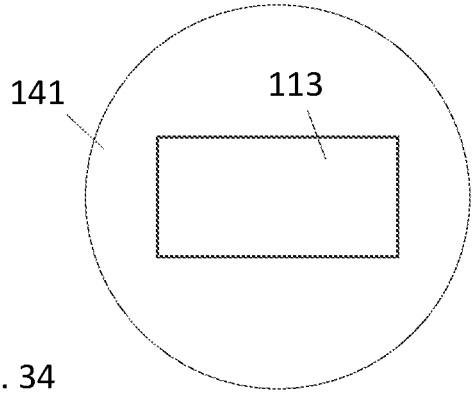
FIG. 34 illustrates a front view of an embodiment of a light holder mount.

With reference to FIG. 34, the light holder mount 141 can have an oval or a circular shape with an outer diameter that is equal to or slightly larger than the inner width of the belt pocket. The light holder mount 141 which can be made of a thin flexible plastic material. The light holder mount 141 can be rectangular in shape and include a rectangular hole 113 in a center portion. The rectangular hole 113 can be approximately the same shape as the base of the light holder shown in FIGS. 31-33. The rectangular hole 113 can be slightly smaller than the base of the light holder in width and length. For example, the width of the hole 113 can be X and the height of the hole 113 can be Y. The width of the rectangular hole 113 can be X=the width of the base±0.20 inch or less and the height of the rectangular hole 113 can be X=the height of the base±0.20 inch. In a preferred embodiment, the thickness of the light holder mount 111 can be 0.40 inch thick or less.

FIGS. 35-37 illustrate the light holder 101 installed in the hole 113 of the light holder mount 141. The inner surfaces of the hole 113 can surround the base 105. The loops 103 can be positioned on one (outer) side of the light holder mount 141 and the flange 107 can be positioned on the opposite (inner) side of the light holder mount 141. The flange 107 can prevent the light holder 101 from being pulled out forward from the light holder mount 141. While the light holder 101 and the light holder mount 141 have been illustrated as separate components, in some embodiments, the light holder mount 141 and light holder 101 can be integrated into a single structure. While the belt insert 141 has been illustrated as a circle, in other embodiments, the belt insert 141 can be oval, rectangular or other shapes that allow limited rotation within the belt 131.

Figure 38:
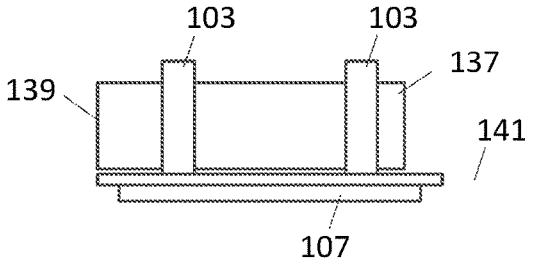
FIG. 38 illustrates a top view of an embodiment of a light in a light holder in a light holder mount.
Figure 39:
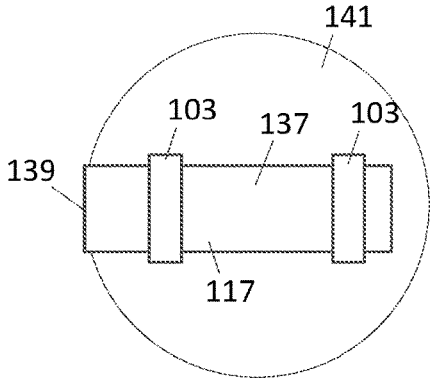
FIG. 39 illustrates a side view of an embodiment of a light in a light holder in a light holder mount.
Figure 40:
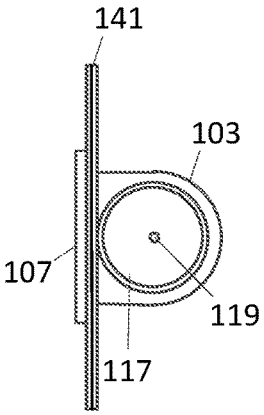
FIG. 40 illustrates a front view of an embodiment of a light in a light holder in a light holder mount.

With reference to FIGS. 38-40, a light 137 inserted in the light holder loops 103 which is coupled to the light holder mount 141 is illustrated. FIG. 38 is a top view, FIG. 39 is a side view and FIG. 40 is a front view. In this embodiment, the light has a cylindrical body with a light element such as a light emitting diode (LED) on one end. The light element can emit a beam that is aligned with the center axis length of the cylindrical body of the light.

Figure 41:
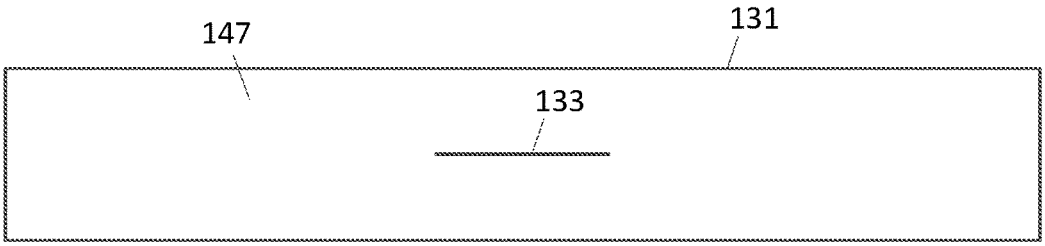
FIG. 41 illustrates a side view of an embodiment of an elastic belt.
Figure 42:
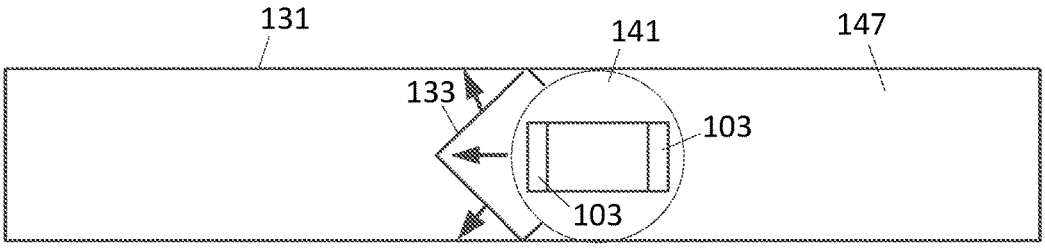
FIGS. 42, 43, 44, and 45 illustrates a side view of an embodiment of a light holder in a light holder mount placed into a pocket opening in an elastic belt.
Figure 43:
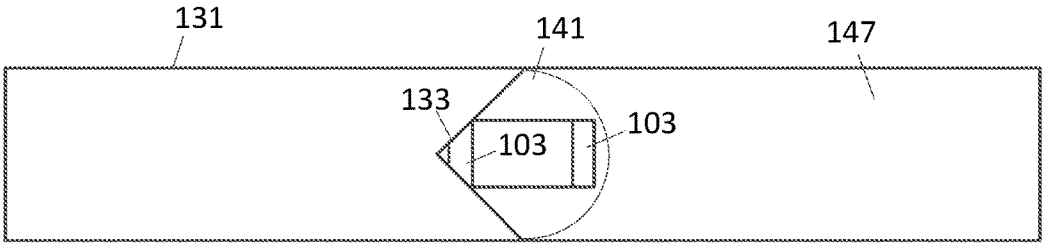
Figure 44:
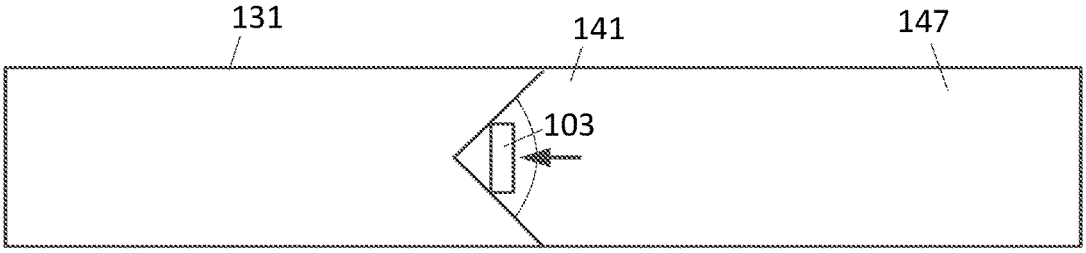
Figure 45:
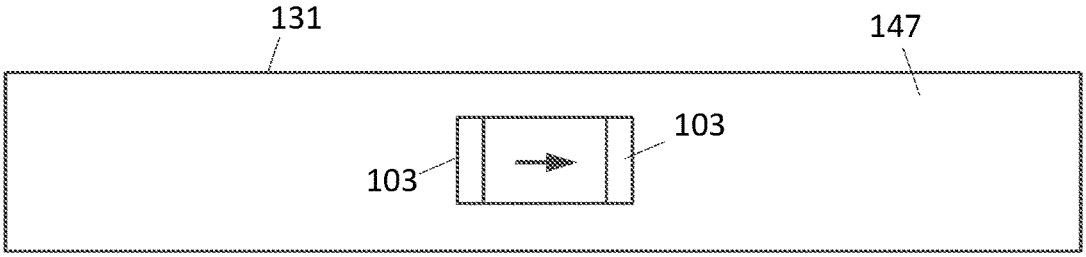

An embodiment of a method for installing the light holder and light holder mount 141 into the belt 131 is illustrated in FIGS. 41-46. With reference to FIG. 41, a side view of an elastic tubular belt 131 is illustrated. The outer layer 147 of a belt 131 can have a slot pocket 133 that is parallel to the upper and lower edges of the belt 131. With reference to FIG. 42, the slot pocket 133 is opened by widening the pocket 133 to a width that is greater than the width of the light holder mount 141. The width of the belt insert 141 can be equal to or slightly wider than the width of the tubular belt pocket. With reference to FIGS. 43 and 44, a first edge of the light holder mount 141 is slid into the slot pocket 133. Because the loop 103 is made of rubber, it can be bent towards the belt insert 141 to allow loop 103 to be inserted into the internal volume of the belt 131. With reference to FIG. 45, the entire light holder mount 141 has been placed into the belt 131. The light holder mount 141 is slid back in the opposite direction so that both loops 103 extend out of the slot pocket 133. The light holder mount 141 is held in a stable vertical position by the upper and lower edges of the internal belt pocket. The loops 103 are also held vertically and horizontally by the inner surfaces of the slot pocket 133.

In other embodiments, the light holder mount 141 can be inserted into the slot pocket 133 without having to place either of the loops 103 into the slot pocket 133. More specifically, the slot pocket 133 can be stretched around the perimeter of the belt insert 141 without having to insert a loop 103 into the slot pocket 133. In these embodiments, the light holder mount 111 sequence can go from FIG. 42 to FIG. 45 without inserting either of the loops 103 into the slot pocket 133.

Figure 46:
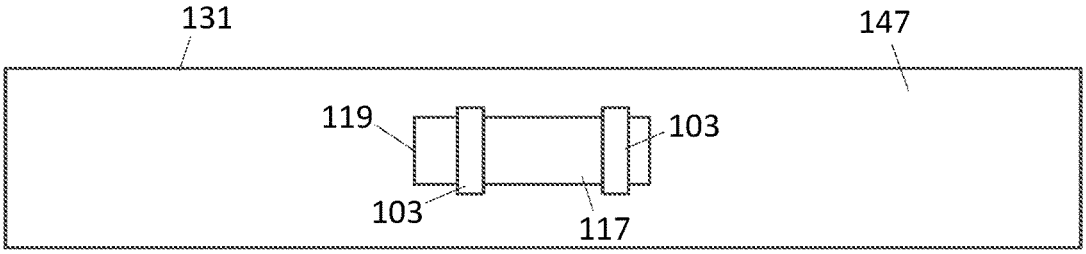
FIG. 46 illustrates a side view of an embodiment of a light placed in a light holder in a light holder mount placed into a pocket opening in an elastic belt.

With reference to FIG. 46, the light housing 107 is placed within the loops 103 with the light 119 facing forward from the belt 131. A light beam emitted by the light 119 can be tangential to the perimeter of the belt 131. The described process can result in a light 119 being attached to one side of the belt 131. It can be desirable to have two lights on opposite sides of the belt 131 as well.

Figure 47:
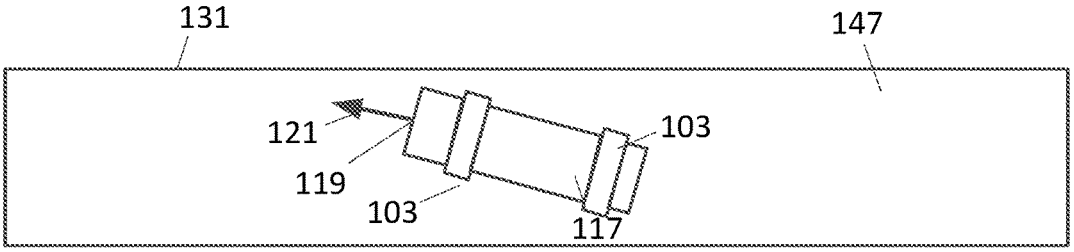
FIG. 47 illustrates a side view of an embodiment of a light rotated up in a light holder in a light holder mount placed into a pocket opening in an elastic belt.
Figure 48:
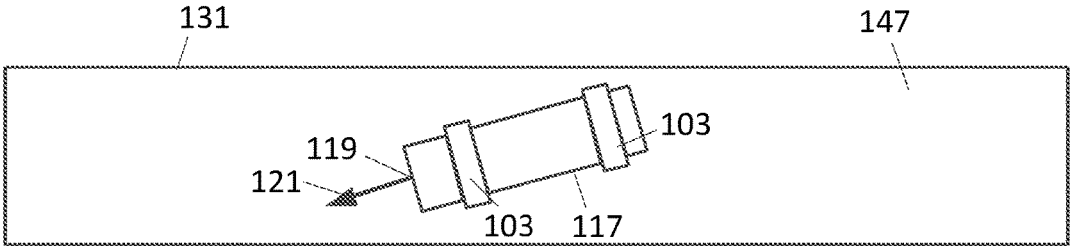
FIG. 48 illustrates a side view of an embodiment of a light rotated down in a light holder in a light holder mount placed into a pocket opening in an elastic belt.
Figure 49:
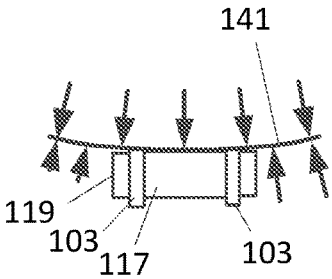
FIG. 49 illustrates a top view of an embodiment of a light in a light holder in an arched light holder mount.

Because the light holder mount 141 can be circular in shape, the light holder mount 141 can rotate within the tubular belt 131. With reference to FIG. 47 the light holder mount 141 is rotated so that the light beam 121 faces up and with reference to FIG. 48, the light holder mount 141 is rotated so that the light beam 121 faces down. With reference to FIG. 49, the light holder mount 141 can be compressed between the inner layer 145 and the outer layer 147 of the belt. More specifically, the user's waist may exert an outward force on the light holder mount 141 and the outer layer 147 may exert a compressive force inward against the light holder mount 141. The compression of the light holder mount 141 can help to hold the light holder mount 141 in place and hold the light 117 in a steady position on the belt 131. The light holder mount 141 can bend to match the curvature of the belt 131.

Figure 50:
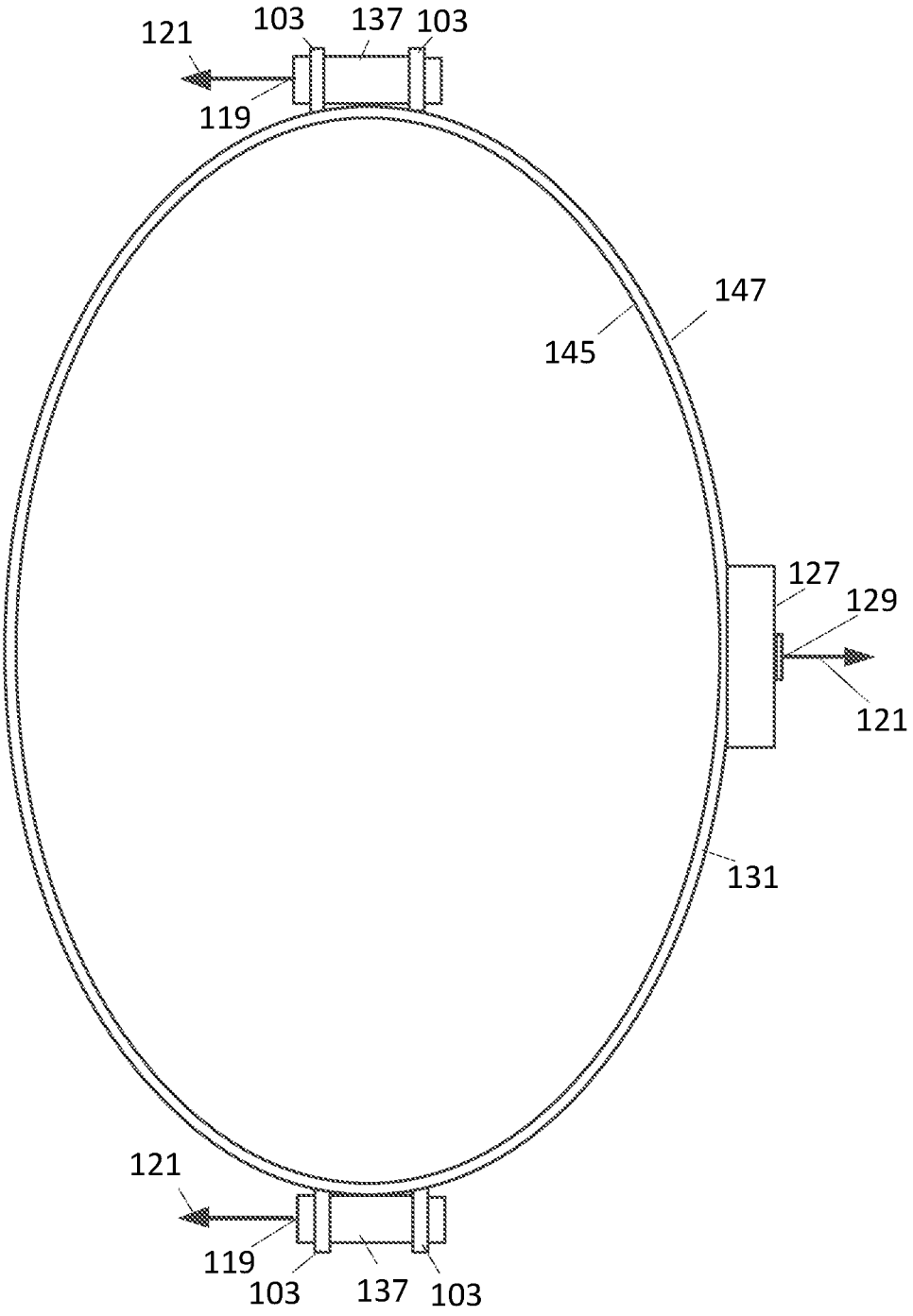
FIG. 50 illustrates a top view of an embodiment of an elastic belt with side and rear lights.

In an embodiment, with reference to FIG. 50, lights 137 can be mounted on opposite sides of the belt 131. In this example, both lights 137 are on opposite sides of the belt 131 and both lights 137 can emit light in a forward direction. Alternatively, as discussed, a user can rotate one light can face forward while the other light can be rotated to face backwards. In an embodiment a second rear light 129 is facing away from the rear of the belt 131. In this embodiment, the second rear light 129 can be attached to a battery pack 127 which can be used to power the lights on the belt 131.

In some embodiments, a light and light housing can be attached to a hinge and a light holder plate. Thus, an elastic light holder is not used. With reference to FIG. 51, a light holder mount 111 can be rectangular in shape with a hole 113 that is offset from the center of the light holder mount 111.

With reference to FIGS. 52-56, this light holder mount 111 can be used with a light housing 151 having a light 119 that can be attached to a hinge 153 and a light holder plate 155. With reference to FIG. 52, the plate 155 has been placed partially through the hole 113 in the light holder mount 111. With reference to FIG. 53, the plate 155 has been placed completely through the hole 113 in the light holder mount 111. With reference to FIG. 54, the plate 155 has been placed completely through the hole 113 and the light holder mount 111 is moved up so that the hinge 153 is adjacent to a lower edge of the hole 113. FIG. 55 illustrates a top view and FIG. 56 illustrates a front view of the light housing 151 and light holder mount 111. The light holder mount 111 can have a width that is the same or slightly greater than the width of the tubular pocket within the belt 131. The light holder mount 111 can be inserted into the belt 131 in the same manner described above with reference to FIGS. 22-27.

Figure 57:
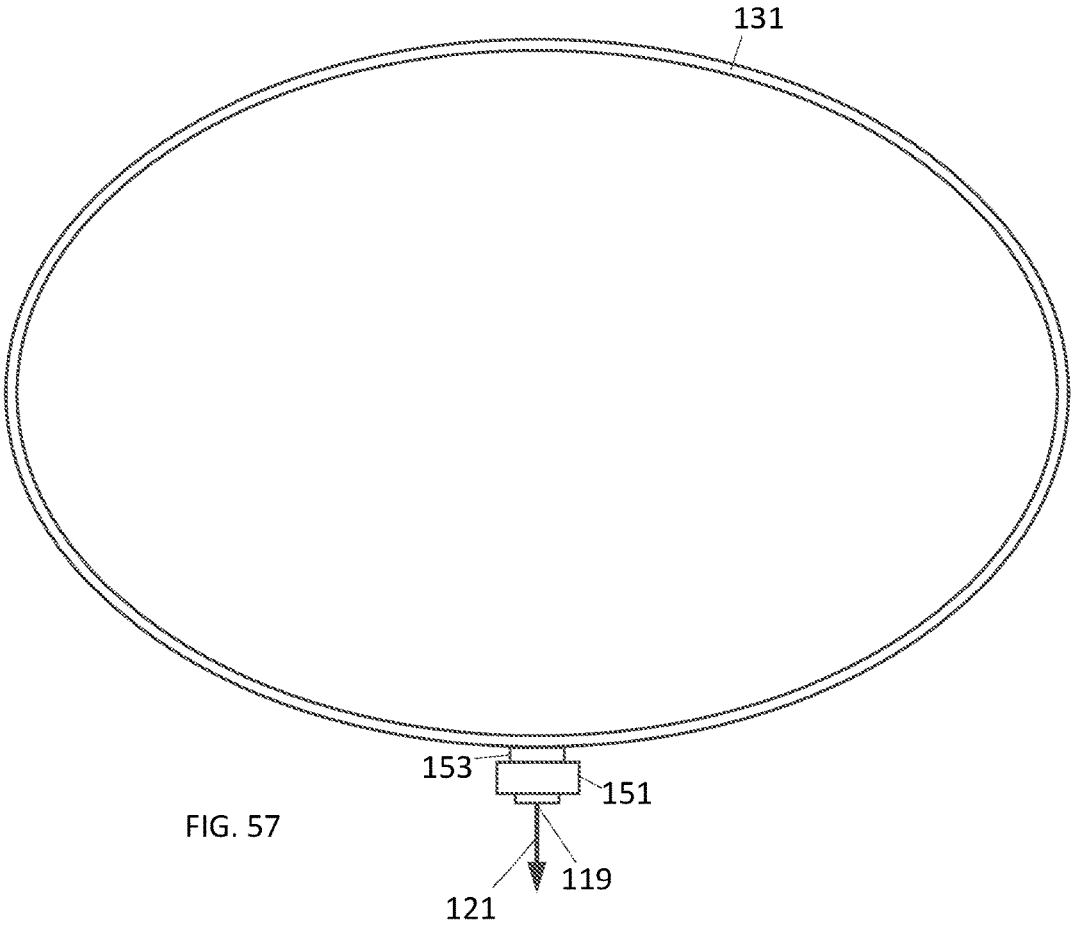
FIG. 57 illustrates a top view of an embodiment of a light attached to a holder mount placed in an elastic belt.
Figure 58:
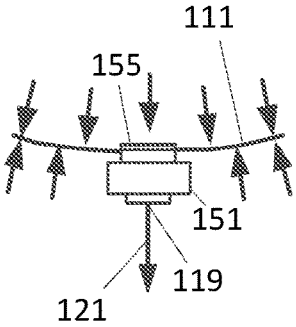
FIG. 58 illustrates a top view of an embodiment of a light attached to a arched holder mount.

A top view of the assembled light holder and belt insert is illustrated in FIG. 57. In this embodiment, the light 119 is facing away from the front of the belt 131. The belt 131 can be made with an inner layer and an outer layer forming a tubular structure. With reference to FIG. 58, the light holder mount 111 can be compressed between the inner layer and the outer layer of the belt 131. More specifically, the user's waist may exert an outward force on the light holder mount 111 and the outer layer may exert a compressive force inward against the light holder mount 111. The compression of the light holder mount 111 can help to hold the light holder mount 111 in place and hold the light 117 in a steady position on the belt 131. The light holder mount 111 can bend to match the curvature of the belt 131.

Figure 59:
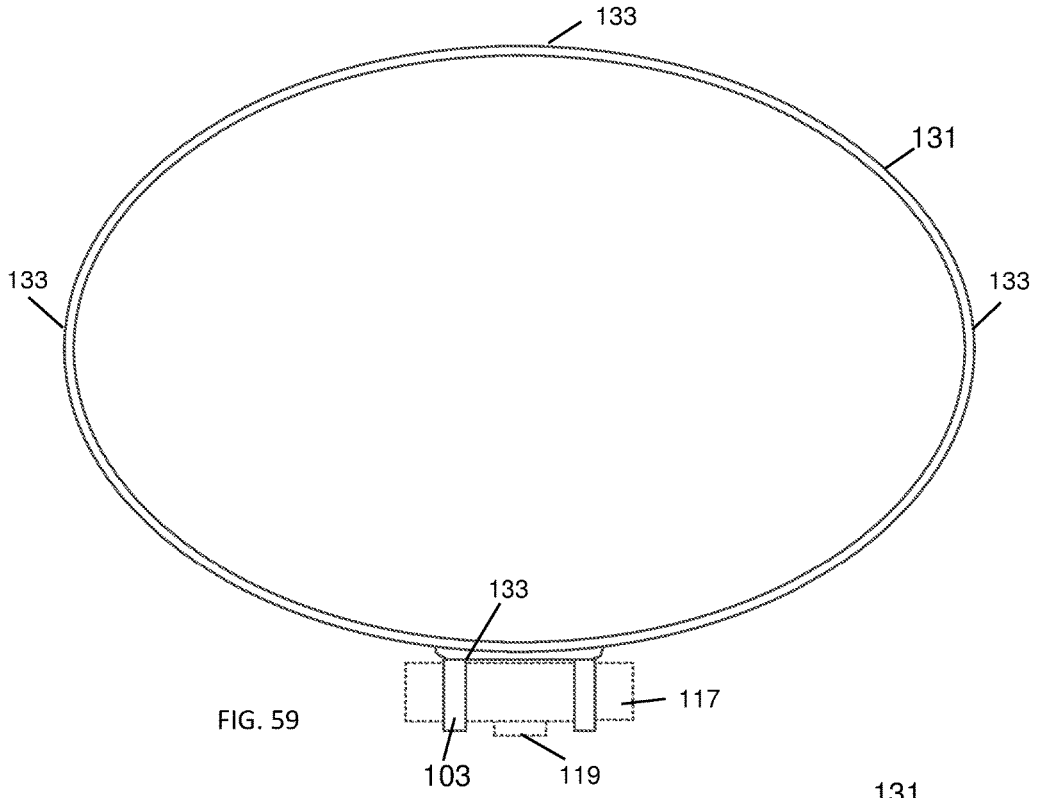
FIG. 59 illustrates a top view of an embodiment of a light holder in a pocket of an elastic belt.
Figure 60:
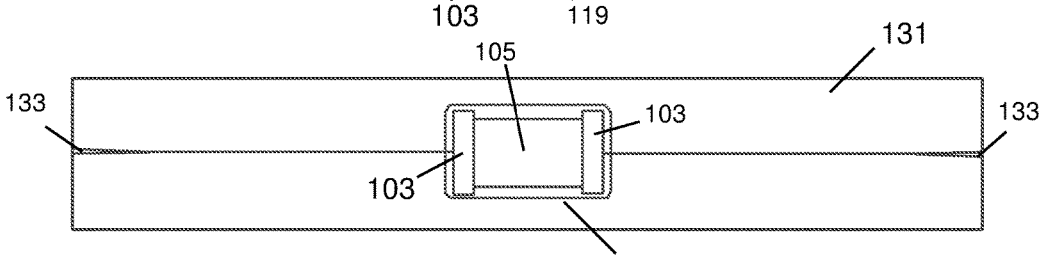
FIG. 60 illustrates a front view of an embodiment of a light holder in a pocket of an elastic belt.
Figure 61:
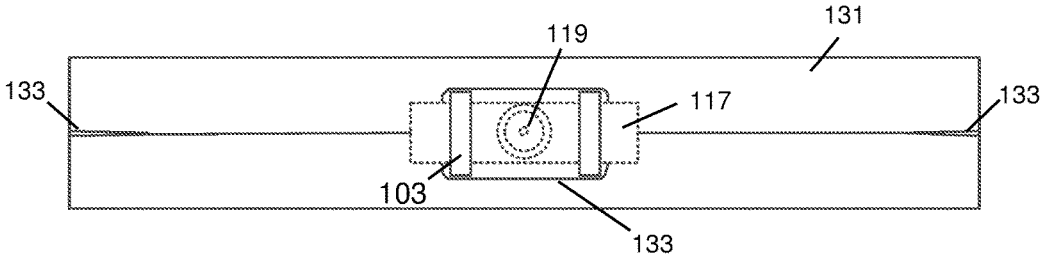
FIG. 61 illustrates a front view of an embodiment of a light in a light holder in a pocket of an elastic belt.
Figure 62:
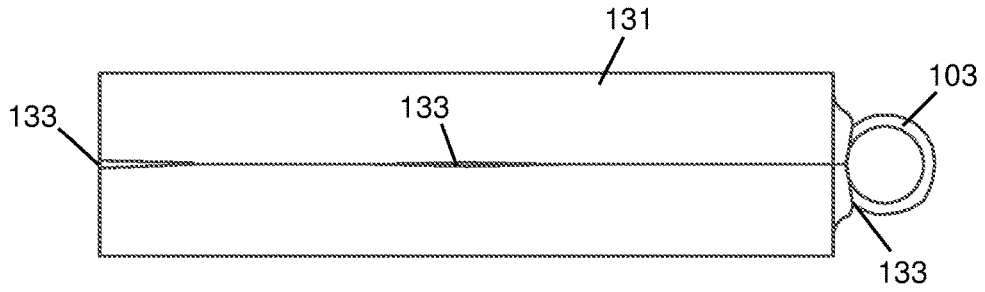
FIG. 62 illustrates a rear view of an embodiment of an elastic belt.
Figure 63:
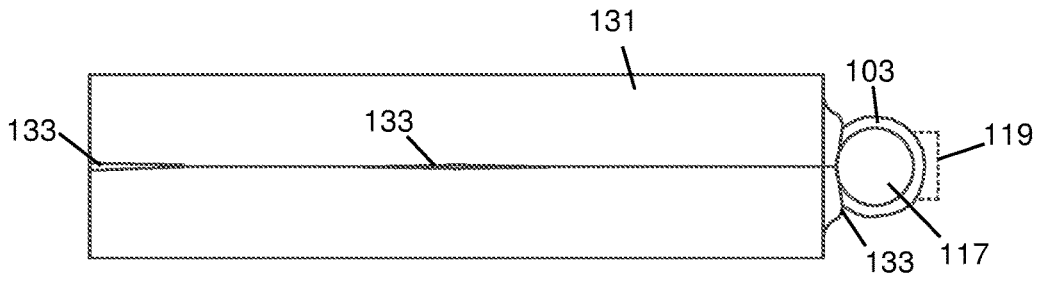
FIG. 63 illustrates a side view of an embodiment of a light holder in a pocket of an elastic belt.

FIGS. 59-64 illustrate different view of an embodiment of a light holder in a light holder mount held in a tubular belt having multiple slot pockets around the perimeter of the belt with the slot pockets positioned in the middle section of the width of the belt. FIG. 59 illustrates a top view of a belt 131 having a light holder with loops 103 extending outward from a pocket 133 of the belt 131. A light housing 117 can be placed through the loops 103 with a light 119 facing outward from the belt 131. FIG. 60 illustrates a front view of the belt 131 with the loops 103 and the base 105 of the light holder visible through the expanded front pocket 133. FIG. 61 illustrates a front view of the belt 131 with the loops 103 and the base 105 of the light housing 117 positioned through the loops 103 and the light 119 facing forward. The elastic belt 131 can be worn around the waist or hips of a user. The angle of the light 119 can be adjusted by rotating the light housing 117 within the loops 103. FIG. 62 illustrates a side view of a belt 131 with the loops 103 of the light holder extending from the front pocket 133. FIG. 63 illustrates a side view of a belt 131 with a light housing 117 placed in the loops 103 of the light holder extending from the front pocket 133 and the light 119 facing forward.

While the embodiments described above are directed towards belt inserts coupled to light holders that are inserted through horizontal slot openings in an outer layer, in other embodiments, the present invention can be used with belts that have overlapping pockets. In these embodiments, the tubular belt may include an inner layer, a lower outer layer that is coupled to the lower edge of the inner layer and an upper outer layer that is coupled to the upper edge of the inner layer. The upper outer layer may over lap with the lower outer layer. In these embodiments, the belt insert shown in FIGS. 5-7 can be placed in the belt by lifting the upper outer layer and inserting the lower edge of the belt insert 111 between the lower outer layer and the inner layer. The upper outer layer can then be secured over the upper edge of the belt insert 111. The inward compress of the upper outer layer and the lower outer layer can hold the belt insert 111 in place and the light housings can be coupled to the loops 103 in the light holder 101 as described above.

In an embodiment, it can be desirable to adjust the circumferential tension of the belt. This tension adjustment can be useful when the user wants to control the vibration or bouncing of the light extending from a pocket of the belt. The belt can be in a relaxed state when the belt is being placed on the user or removed from the user. When the belt is on the user the circumferential tension of the inner belt can be increased to more securely hold the light in position on the user. There are various mechanisms that can be used to adjust the tension in the belt. FIGS. 64-72 illustrate three embodiments of an elastic belt with tension adjusting mechanisms.

Figure 64:
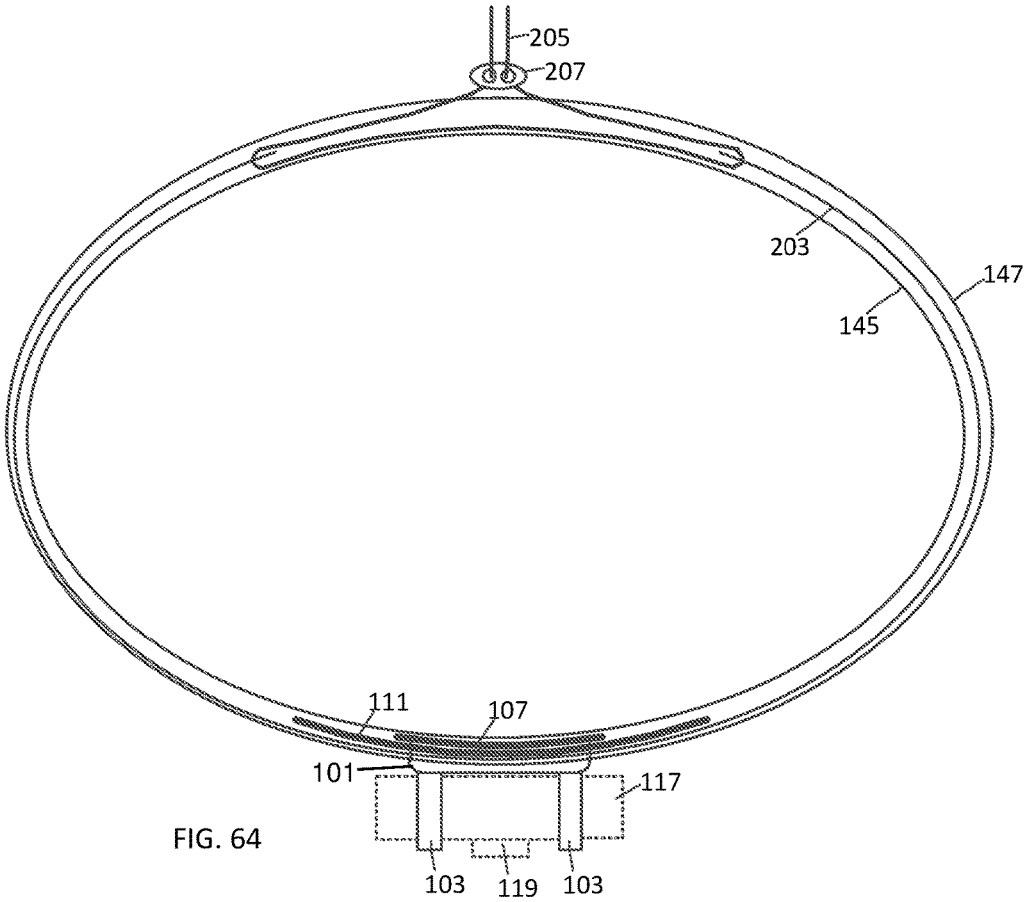
FIG. 64 illustrates a top section view of an embodiment of a light in a light holder in a pocket of an elastic belt with a tension adjuster.
Figure 65:
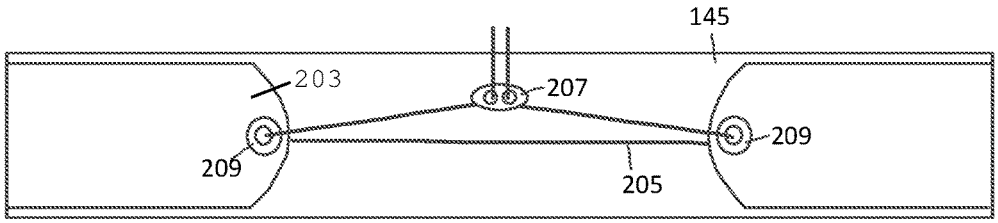
FIG. 65 illustrates a rear section view of an embodiment of an elastic belt with a tension adjuster.
Figure 66:
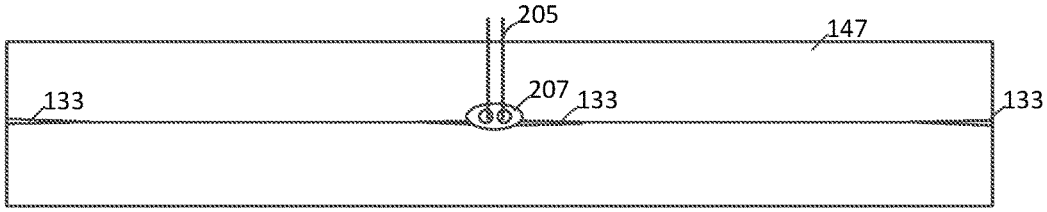
FIG. 66 illustrates a rear view of an embodiment of an elastic belt with a tension adjuster.

In a first embodiment, a light holder can be attached to an inner elastic band that has an end or ends that can be adjustable. With reference to FIGS. 64-66, the light holder mount 111 can be positioned between inner elastic band 203 of the elastic belt and the inner layer of the elastic belt. FIG. 64 illustrates a top view showing the internal view of the elastic belt. The ends of the inner elastic band 203 can be coupled to a tension line 205 that can pull the ends towards each other. For example, portions of a line 205 can be coupled to the ends of inner elastic band 203. The end portions of the line 205 can be coupled to a line locking mechanism 207 so the line 205 can be pulled and tensioned to stretch the inner elastic band 203 and the line locking mechanism 207 can hold the line 205 in place. The line 205 and the line locking mechanism 207 can be positioned between inner elastic band 145 of the elastic belt and the outer layer 147 of the elastic belt. In an embodiment with reference to FIG. 65 a rear view of the inner belt 203 and with reference to FIG. 66, a rear view of an elastic belt are illustrated. The tension line 205 can be looped through holes 209 formed in the ends of the inner elastic band 203 and then feed to the line locking mechanism 207. The tension line 205 and the line locking mechanism 207 can be pulled out of the rear pocket away from the elastic belt, the tension line 205 can pull the ends of the inner elastic belt 203 towards each other to increase the elastic belt tension. The holes 209 in the ends of the inner elastic belt can have grommets, which can provide a smooth sliding surface for the line 205 and function as pulleys resulting in increased purchase when the tension line 205 is tensioned. The user can pull the tension line 205 and slide the line locking mechanism 207 towards the belt and then actuate the line locking mechanism 207 to lock the lines 205 in place at the user desired tension on the inner elastic belt 203. Conversely, the user can release the line locking mechanism 207 to unlock the lines 205 and release the elastic belt tension.

Figure 67:
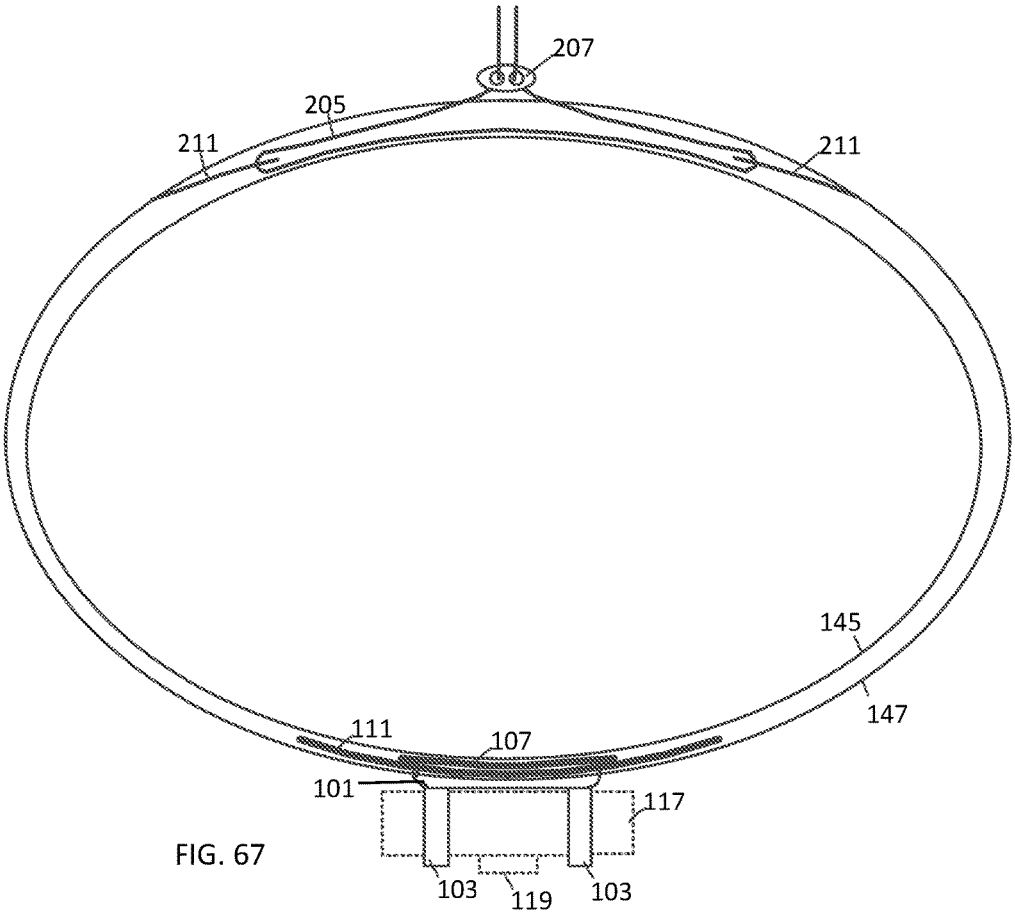
FIG. 67 illustrates a top section view of an embodiment of a light in a light holder in a pocket of an elastic belt with a tension adjuster.
Figure 68:
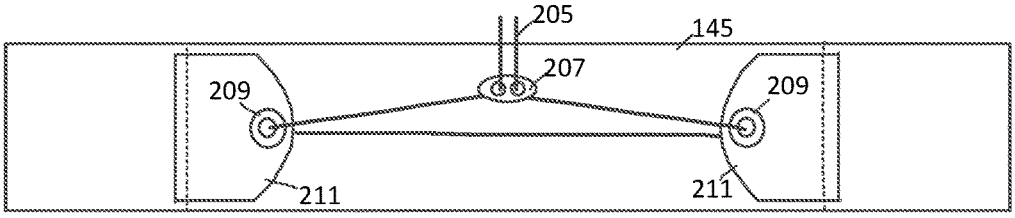
FIG. 68 illustrates a rear section view of an embodiment of an elastic belt with a tension adjuster.
Figure 69:
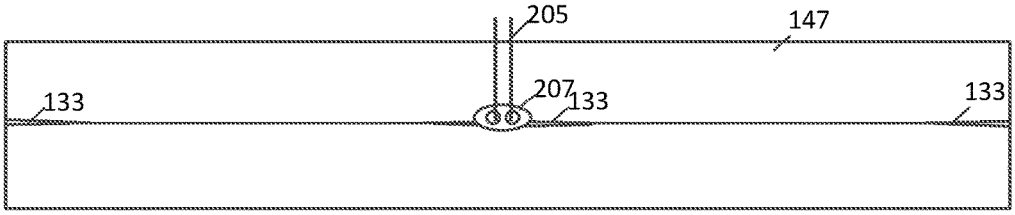
FIG. 69 illustrates a rear view of an embodiment of an elastic belt with a tension adjuster.

In another embodiment with reference to FIGS. 67-69, the elastic belt tension control mechanism can include tabs 211 sewn to the outer layer 147 of the elastic belt, a tension line 205 and a line locking mechanism 207. FIG. 67 illustrates a top view showing the internal view of the elastic belt, FIG. 68 illustrates a rear view of the tabs 211 and tension mechanism and FIG. 69 illustrates a rear view of the elastic belt. The tension line 205 can be attached to the ends of the tabs 211 and the ends of the tension line can be attached to the line locking mechanism 207. By pulling the tension line 205 and the line locking mechanism 207 out of the rear pocket 133 away from the elastic belt, the tension line 205 can pull the tabs 211 towards each other to increase the elastic belt tension and more securely hold the light holder 101 to the elastic belt. The user can hold the tension line 205 and slide the line locking mechanism 207 towards the belt and then actuate the line locking mechanism 207 to achieve the desired user tension on the elastic belt.

In yet another embodiment, the tension mechanism can be a removable device attached to the elastic belt when needed and then removed when the tension adjustment is not needed. For example, if the light is attached to the elastic belt, it can be necessary to have an adjustable tension mechanism so that the light can be held securely against the user. When the light is removed from the elastic belt it may not be necessary to adjust the tension and the tension adjusting mechanism can be removed.

Figure 70:
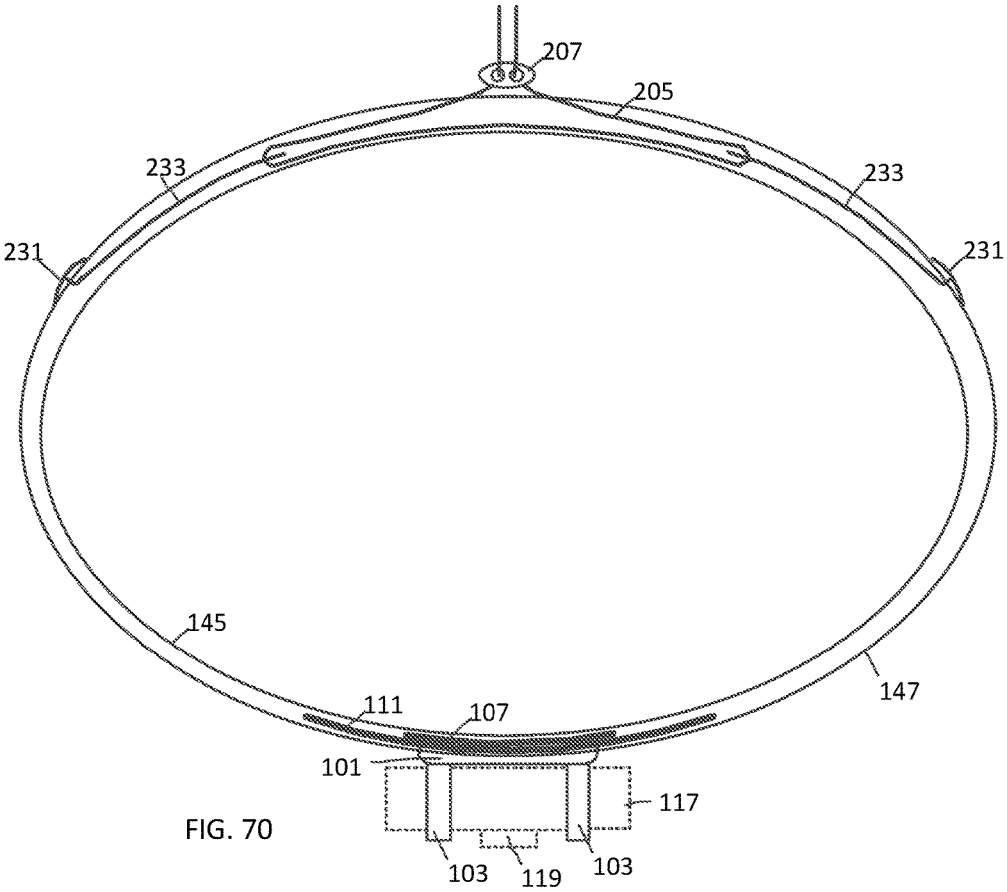
FIG. 70 illustrates a top section view of an embodiment of a light in a light holder in a pocket of an elastic belt with a tension adjuster.
Figure 71:
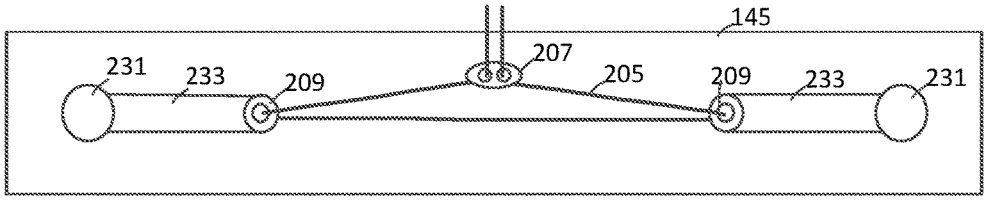
FIG. 71 illustrates a rear section view of an embodiment of an elastic belt with a tension adjuster.
Figure 72:
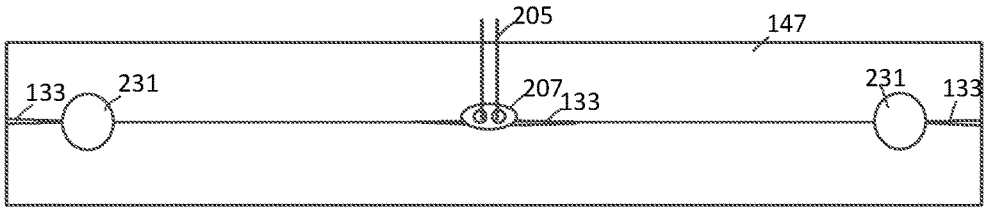
FIG. 72 illustrates a rear view of an embodiment of an elastic belt with a tension adjuster.

With reference to FIGS. 70-72, an embodiment of the removable tension device is illustrated. FIG. 70 illustrates a top view showing the internal view of the elastic belt, FIG. 71 illustrates a rear view of pocket clips 231 and tension mechanism and FIG. 72 illustrates a rear view of the elastic belt. The removable tension device can include a tension line 205 that has pocket clips 231 and a line locking mechanism 207. The tension line 205 can be positioned within the inner layer 145 and the outer layer 147 of the elastic belt. The pocket clips 231 can be buttons that can be attached to the rear ends of the side pockets 133 in the elastic belt and the line locking mechanism can be placed in the rear center pocket 133 of the elastic belt. The pocket clips 231 can be attached to one end of an elongated flexible member 233 and another end of the elongated flexible member 233 can be attached to holes 209 which can be formed in grommets attached to the flexible member 233. By pulling the tension line 205 and the line locking mechanism 207 out of the rear pocket 133 away from the elastic belt, the tension line 205 can pull the ends of the pocket clips 231 towards each other to increase the elastic belt tension. With reference to FIG. 72, the user can hold the tension line 205 and slide the line locking mechanism 207 towards the belt and then actuate the line locking mechanism to maintain or increase the tension on the inner elastic belt.

For all of the described tension adjusting mechanisms, the line locking mechanism can be released and the tension line belt can be extended so the belt is in a relaxed state when the belt is being placed on the user. When the tension line can be tightened and the line locking mechanism can be actuated so the circumferential tension of the inner belt can be increased to more securely hold the light in position on the user. When the belt needs to be removed, the line locking mechanism can be released so the circumferential tension of the inner belt can be decreased to loosen the elastic belt so it can be more easily removed from the user's hips or waist.

Clip Embodiment

Figure 73:
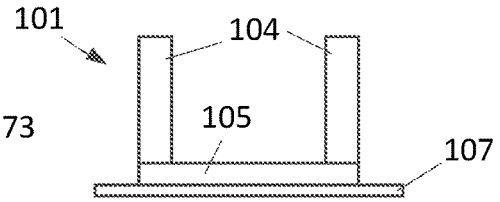
FIG. 73 illustrates a top view of an embodiment of a light holder.
Figure 74:
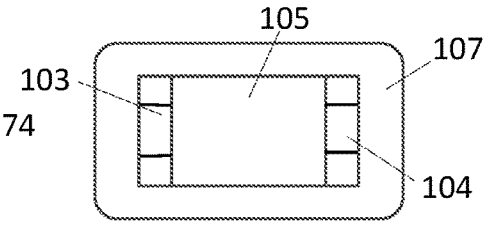
FIG. 74 illustrates a front view of an embodiment of a light holder.
Figure 75:
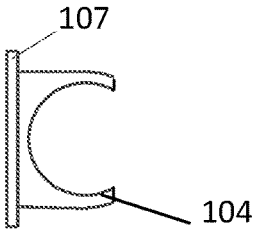
FIG. 75 illustrates a side view of an embodiment of a light holder.

FIGS. 73-75 illustrate a first embodiment of a light holder 101 that includes a base 105 that is coupled to a flange 107 and clips 104 that are perpendicular to the base 105. The base 105 can be rectangular in shape. The flange 107 can also be rectangular in shape and extend outward from the perimeter of the base 105. The clips 104 can include a circular inner diameter. The light holder 101 can be made of a homogeneous elastic material such as plastic or hard rubber. The clips 104 can have a front opening which allows a cylindrical light to be inserted and held securely in place.

Figure 76:
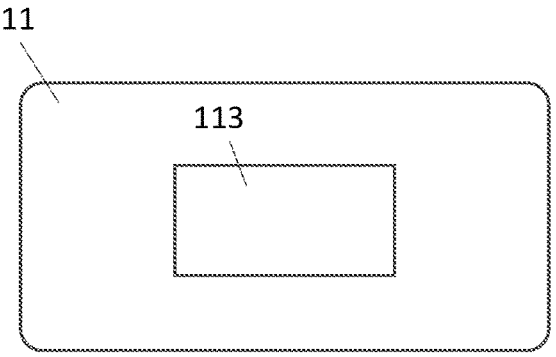
FIG. 76 illustrates a front view of an embodiment of a light holder mount.

FIG. 76 illustrates an embodiment of a light holder mount 111 which can include a thin flexible plastic material layer alone or in combination with one foam layer attached to one side of the plastic layer or two foam layers attached to opposite sides of the plastic layer. In an embodiment, the light holder mount 111 can include an inner foam layer attached to the thin plastic material layer or both an inner foam layer and an outer foam layer that are both attached to the thin flexible plastic material layer. The inner and/or outer foam layers can be flexible and provides a friction surface that resists sliding when the light holder mount 111 is placed in a pocket of a belt. The foam layers can also provide cushioning against the outer surfaces of the flexible plastic material layer. The light holder mount 111 can be oval, rectangular or any other suitable shape. The light holder mount 111 can include a center hole 113 which can be rectangular hole or other suitable shape in a center portion of the light holder mount 111. The rectangular hole 113 in a center portion can be symmetrically positioned or located at the geometric center of the light holder mount 111. The thin plastic material can be flexible in bending, but inelastic in tension so that the light holder mount 111 can easily bend, but the inner rectangular hole 113 cannot expand. Thus, a light holder can be securely held within the hold 113 of the light holder mount 111.

The rectangular hole 113 can be approximately the same shape as the base of the light holder shown in FIGS. 73-75. The rectangular hole 113 can be centered within the light holder mount 111. The rectangular hole 113 can be slightly larger than the base of the light holder in width and height. For example, the width of the hole 113 can be X and the height of the hole 113 can be Y. The width of the rectangular hole 113 can be X=width of the base of the light holder+0.2 inch or less and the length of the rectangular hole 113 can be Y=height of the base of the light holder+0.1 or less. In some embodiments, the base of the light holder can be made of an elastic material and the dimensions of the rectangular hole 113 can be equal to or slightly smaller than the width and height of the base of the light holder. In a preferred embodiment, the thickness of the light holder mount 111 can be 0.40 inch thick or less. The outer corners of the light holder mount 111 can be rounded so that the light holder mount 111 can easily slide through pockets into the belt.

FIG. 76 illustrates a light holder mount 111 having a hole 113. In an embodiment the light holder can have a plastic layer 112 and an inner foam layer 114 and an outer foam layer 114. In an embodiment the plastic layer 112 can be 0.005-0.050 inch thick polycarbonate or any other suitable plastic material and the foam can be 0.050-0.200 inch thick ethylene vinyl acetate (EVA) foam or any other suitable plastic material. The inner foam layer 114 and outer foam layer 114 can be attached to the plastic layer 112 with an adhesive. The inner surfaces of the hole 113 can surround the base 105. The clips 104 can be positioned on one (outer) side of the light holder mount 111 and the flange 107 can be positioned on the opposite (inner) side of the light holder mount 111. The flange 107 can prevent the light holder 101 from being pulled out forward from the light holder mount 111. While the light holder 101 and the light holder mount 111 have been illustrated as separate components, in some embodiments, the light holder mount 111 and light holder 101 can be integrated into a single light holder structure.

Figure 77:
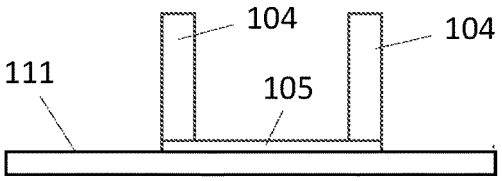
FIG. 77 illustrates a top view of an embodiment of a light holder in a light holder mount.
Figure 78:
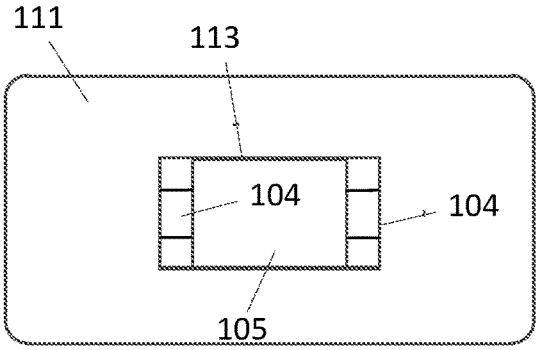
FIG. 78 illustrates a front view of an embodiment of a light holder in a light holder mount.
Figure 79:
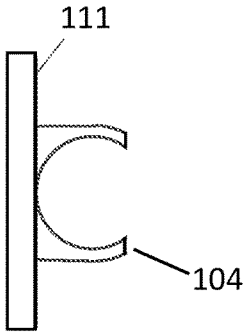
FIG. 79 illustrates a side view of an embodiment of a light holder in a light holder mount.

In other embodiments, with reference to FIGS. 77-79, the light holder can be a single integrated structure with a light holder mount 111, a base 105 and light holder structures 104 which can be clips or loops. The light holder structures 104 can have inner cylindrical surfaces and are substantially perpendicular to the plane of the base 105 and light holder mount 111. The light holder structures 104 can have open fronts to allow the light to be placed into or removed from the light holder structures 104 through the open fronts.

FIGS. 80-82 illustrate an embodiment of a second embodiment of a light holder 102 that includes a base 105 and clips 104 that are perpendicular to the base 105. The base 107 can be rectangular in shape. The clips 104 can include a circular inner diameter. The light holder 102 can be made of a homogeneous elastic material such as plastic or hard rubber. The clips 104 can have a front opening which allows a cylindrical light to be inserted and held securely in place. The light holder can be made of plastic and/or hard rubber material which can be molded into the illustrated shapes.

FIG. 83 illustrates an embodiment of a light holder mount 111 which can include a thin flexible plastic material. The light holder mount 111 can be oval, rectangular or any other suitable shape and can include two rectangular clip holes 115 in a center portion. In a preferred embodiment, the thickness of the belt insert 111 can be 0.10 inch thick.

FIGS. 84-86 illustrate the light holder 101 installed in the holes 115 of the light holder mount 111. The inner surfaces of the holes 115 can surround the base of the clips 104. The clips 104 can be positioned on one (outer) side of the light holder mount 111. The light holder mount 111 and light holder 101 can be integrated into a single light holder structure which can be made of plastic and/or hard rubber.

Figure 87:
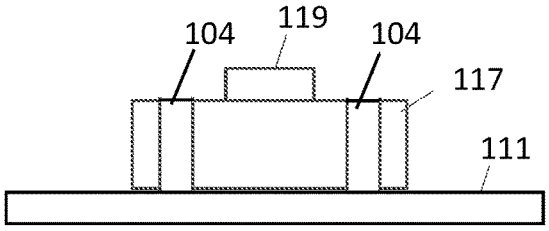
FIGS. 87 illustrates a top view of an embodiment of a light in a light holder in a light holder mount.
Figure 88:
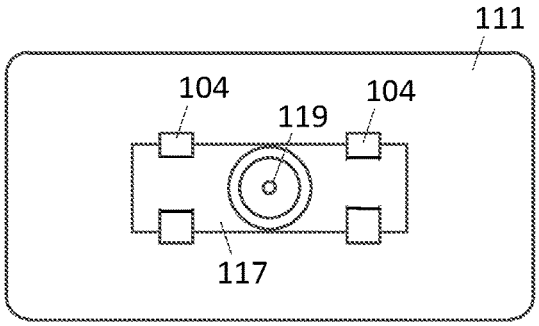
FIG. 88 illustrates a front view of an embodiment of a light in a light holder in a light holder mount.
Figure 89:
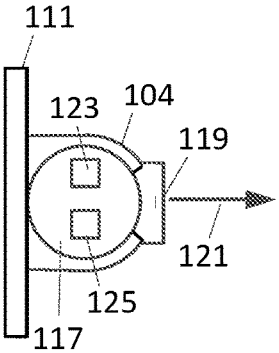
FIG. 89 illustrates a side view of an embodiment of a light in a light holder in a light holder mount.
Figure 90:
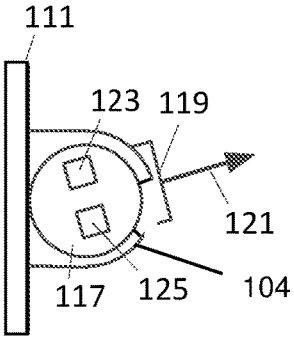
FIGS. 90 and 91 illustrate a side view of an embodiment of a light rotated up in a light holder in a light holder mount.
Figure 91:
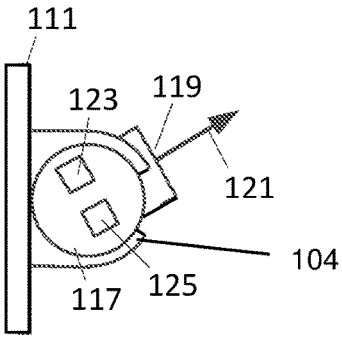
Figure 92:
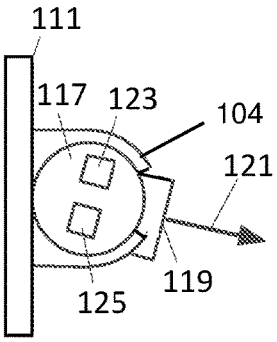
FIGS. 92 and 93 illustrate a side view of an embodiment of a light rotated down in a light holder in a light holder mount.
Figure 93:
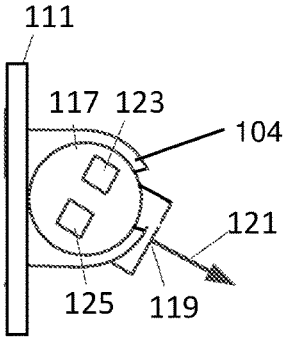

FIGS. 87-89 illustrate a light 119 coupled to an elongated housing 117. In this example, the elongated housing 117 can be partially or completely cylindrical in shape and the light 119 can be mounted on a center portion of the housing 117. A battery such as a rechargeable battery can be placed within the housing 117 and the light can be a high efficiency light emitting diode or any other suitable light source. The light 119 can emit a beam 121 that is substantially perpendicular to the center axis of the housing 117. The ends of the housing 117 on either side of the light 119 can be placed in each end of the clips 104. The housing 117 can include a charging port 123 and a control switch 125. The length of the housing 117 can be greater than length of the hole 113 in the light holder mount 111. When the switch 125 is pressed, the light 119 is illuminated and emits a light beam 121. With reference to FIGS. 89-93, the housing 117 can be rotated within the clips 104 to change the angular position of the light beam 121. With reference to FIGS. 90 and 91, the light housing 117 and light beam 121 are rotated upward. With reference to FIGS. 92 and 93, the light housing 117 and light beam 121 are rotated downward.

Figure 94:
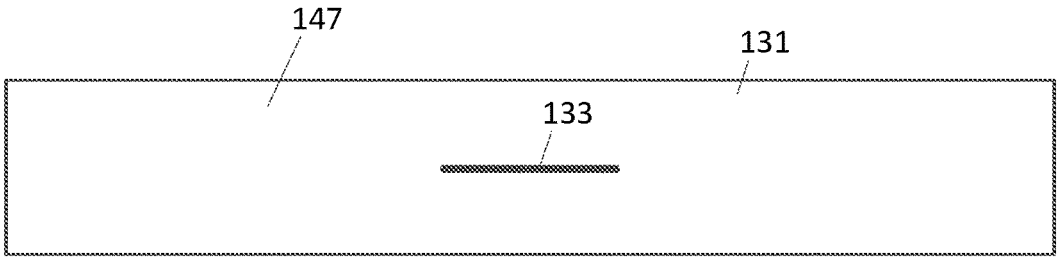
FIG. 94 illustrates a front view of an embodiment of an elastic belt.
Figure 95:
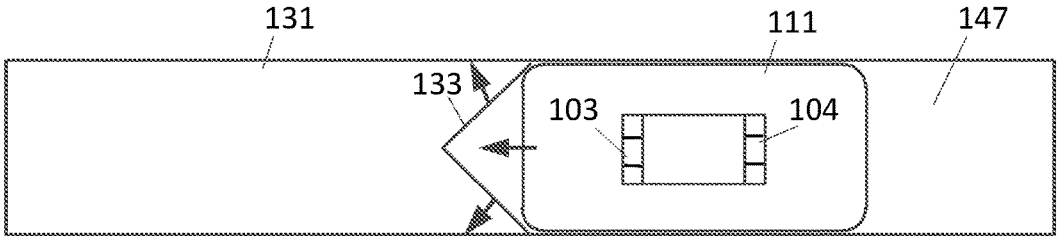
FIGS. 95, 96, 97 and 98 illustrates a front view of an embodiment of a light holder in a light holder mount placed into a pocket opening in an elastic belt.
Figure 96:
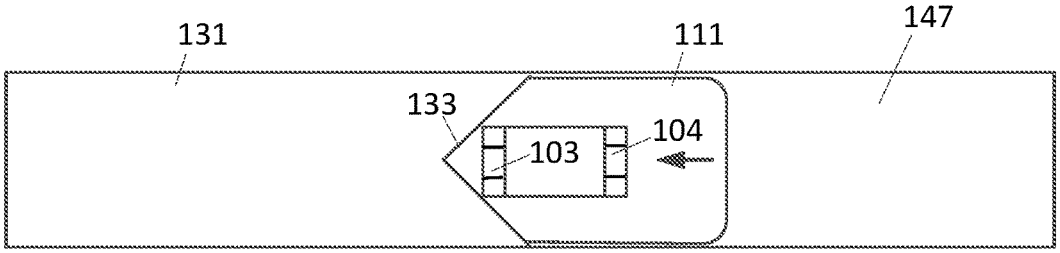
Figure 97:
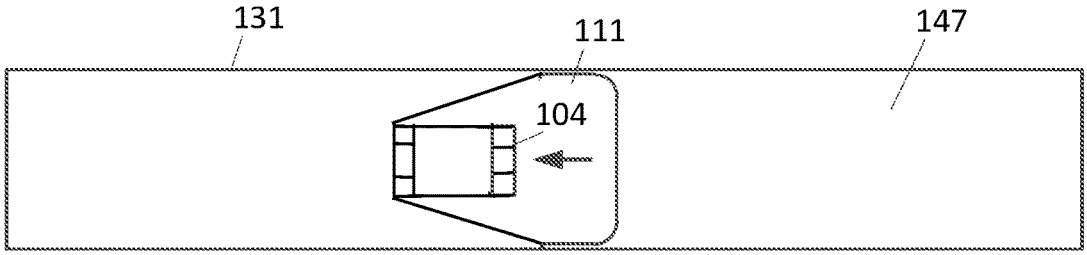
Figure 98:
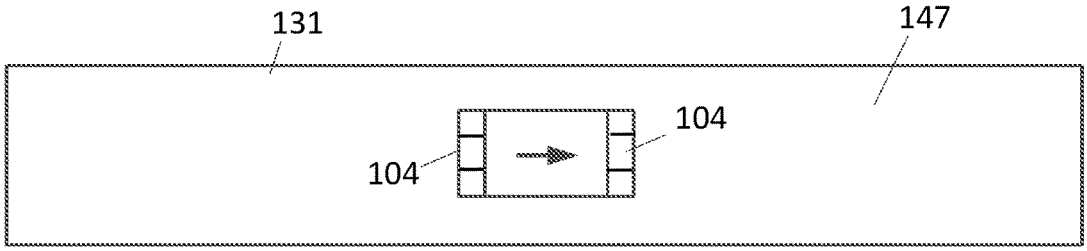

An embodiment of a method for installing the light holder and light holder mount 111 is illustrated in FIGS. 93-99. With reference to FIG. 94, a front view of an elastic tubular belt 131 is illustrated. The outer layer 147 of a belt 131 can have a slot pocket 133 that is parallel to the upper and lower edges of the belt 131. With reference to FIG. 95, the slot pocket 133 is opened by widening the pocket 133 to a width that is greater than the width of the light holder mount 111. The width of the light holder mount 111 can be equal to or slightly narrower or wider than the width of the tubular belt pocket. With reference to FIG. 96, a first edge of the light holder mount 111 is slid into the slot pocket 133. With reference to FIG. 97, the pocket can be stretched around the clips 104 and around a second edge of the light holder mount 111. With reference to FIG. 98, the entire light holder mount 111 has been placed into the belt 131. The light holder mount 111 is slid back in the opposite direction so that both clips 104 extend out of the slot pocket 133. The light holder mount 111 is held in a stable vertical position by the upper and lower edges of the internal belt pocket. The clips 104 are also held vertically and horizontally by the inner surfaces of the slot pocket 133.

Figure 99:
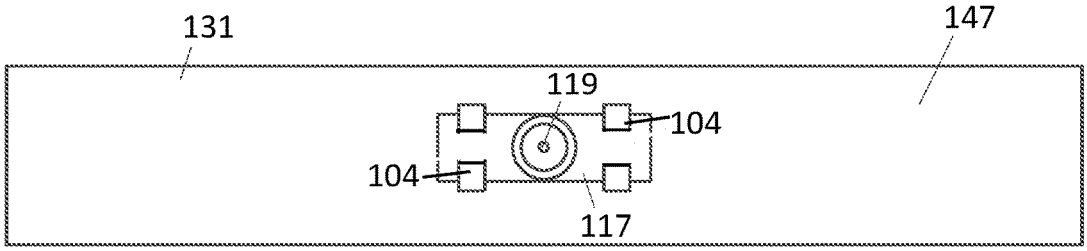
FIG. 99 illustrates a front view of an embodiment of a light placed in a light holder in a light holder mount placed into a pocket opening in an elastic belt.

With reference to FIG. 99, the light housing 107 is placed within the clips 104 with the light 119 facing outward from the belt 131. The opposite procedure or steps can be performed to remove the light holder mount 111 from the belt 131. The removal can be useful if the user needs to remove all attachments to wash the belt 131.

In other embodiments, the light holder mount 111 can be inserted into the slot pocket 133 without having to remove the light 117 from the clips 104. More specifically, the slot pocket 133 can be stretched around the perimeter of the light holder mount 111 while the light 117 is inserted the clips 104. Thus, the light 117 and the mount 111 can be inserted into and/or removed from the slot pocket 133 in an assembled state.

Figure 100:
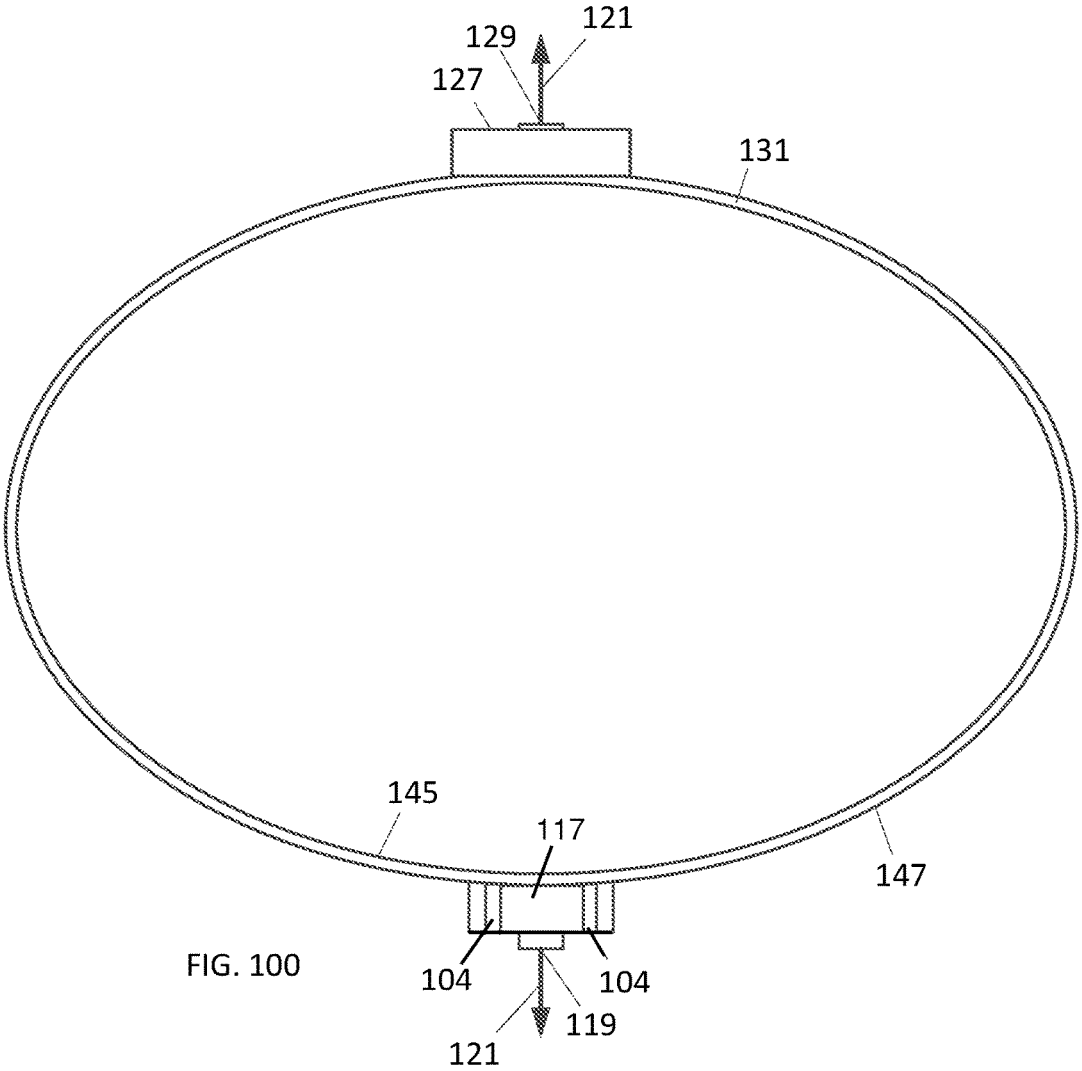
FIG. 100 illustrates a top view of an embodiment of a front light placed in a light holder in a light holder mount placed into a pocket opening in an elastic belt and a rear light attached to the elastic belt.
Figure 101:
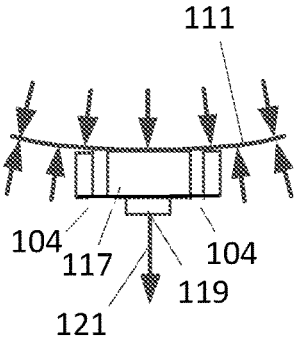
FIG. 101 illustrates a top view of an embodiment of a front light placed in a light holder in an arched light holder mount.

A top view of the assembled light holder and belt insert is illustrated in FIG. 100. In this embodiment, the light 119 is facing away from the front of the belt 131 and a second rear light 129 is facing away from the rear of the belt 131. The second rear light 129 can be attached to a battery pack 127 which can be used to power the lights in the belt. The belt 131 can be made with an inner layer 145 and an outer layer 147 forming a tubular structure. With reference to FIG. 101, the light holder mount 111 can be compressed between the inner layer 145 and the outer layer 147. More specifically, the user's waist may exert an outward force on the light holder mount 111 and the outer layer 147 may exert a compressive force inward against the light holder mount 111. The compression of the light holder mount 111 can help to hold the light holder mount 111 in place and hold the light 117 in a steady position on the belt 131. The light holder mount 111 can bend to match the curvature of the belt 131. The bending of the light holder mount 111 can cause this structure to rigid in vertical compression and resist vertical forces on the upper and lower edges of the light holder mount 111. In contrast, the light holder mount 111 can be flexible in response to horizontal forces.

Figure 102:
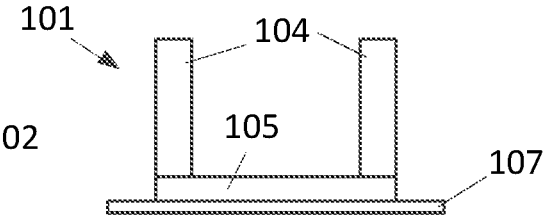
FIG. 102 illustrates a top view of an embodiment of a light holder.
Figure 103:
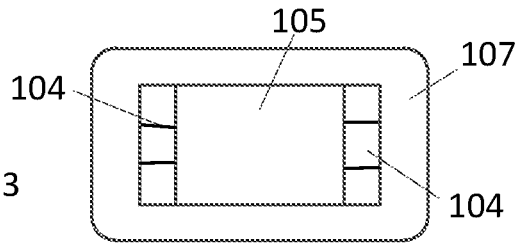
FIG. 103 illustrates a front view of an embodiment of a light holder.
Figure 104:
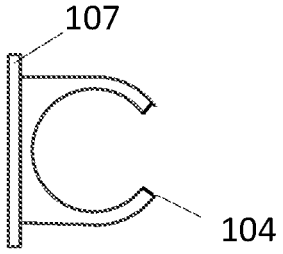
FIG. 104 illustrates a side view of an embodiment of a light holder.

With reference to FIGS. 102-109, in another embodiment the light holder 101 can be used with an oval or a circular light holder mount 141. FIGS. 102-104 illustrate a first embodiment of a light holder 101 that includes a base 105 that is coupled to a flange 107 and clips 104 that are perpendicular to the base 105. The base 105 can be rectangular in shape. The flange 107 can also be rectangular in shape and extend outward from the perimeter of the base 105. The clips 104 can include a circular inner diameter. The light holder 101 can be made of a homogeneous elastic material such as plastic or hard rubber.

Figure 105:
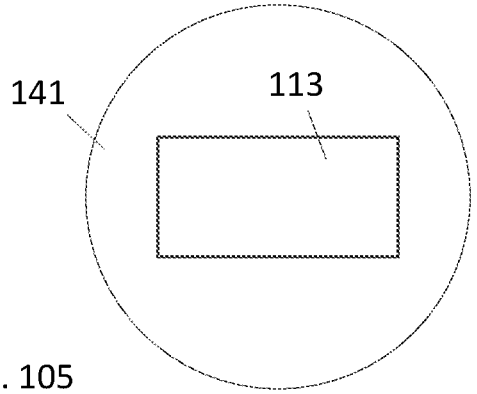
FIG. 105 illustrates a view of an embodiment of a light holder mount.

With reference to FIG. 105, the light holder mount 141 can have an oval or a circular shape with an outer diameter that is equal to or slightly larger than the inner width of the belt pocket. The light holder mount 141 which can be made of a thin flexible plastic material. The light holder mount 141 can be rectangular in shape and include a rectangular hole 113 in a center portion. The rectangular hole 113 can be slightly smaller than the base of the light holder in width and length. For example, the width of the hole 113 can be X and the height of the hole 113 can be Y. The width of the rectangular hole 113 can be X=the width of the base±0.20 inch or less and the height of the rectangular hole 113 can be X=the height of the base±0.20 inch. In a preferred embodiment, the thickness of the light holder mount 111 can be 0.40 inch thick or less.

FIGS. 106-108 illustrate the light holder 101 installed in the hole 113 of the light holder mount 141. The inner surfaces of the hole 113 can surround the base 105. The clips 104 can be positioned on one (outer) side of the light holder mount 141 and the flange 107 can be positioned on the opposite (inner) side of the light holder mount 141. The flange 107 can prevent the light holder 101 from being pulled out forward from the light holder mount 141. While the light holder 101 and the light holder mount 141 have been illustrated as separate components, in some embodiments, the light holder mount 141 and light holder 101 can be integrated into a single light holder structure which can be made of plastic and/or hard rubber. While the belt insert 141 has been illustrated as a circle, in other embodiments, the belt insert 141 can be oval, rectangular or other shapes that allow limited rotation within the belt 131.

Figure 109:
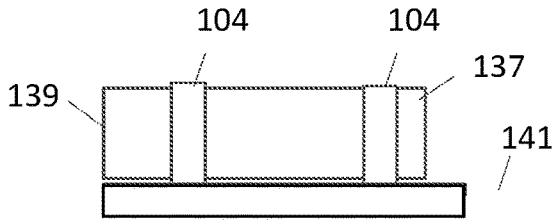
FIG. 109 illustrates a top view of an embodiment of a light in a light holder in a light holder mount.
Figure 110:
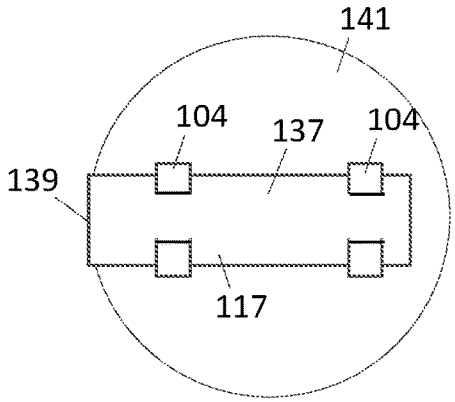
FIG. 110 illustrates a side view of an embodiment of a light in a light holder in a light holder mount.
Figure 111:
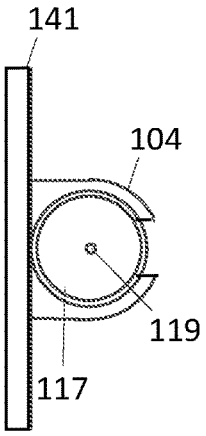
FIG. 111 illustrates a front view of an embodiment of a light in a light holder in a light holder mount.

With reference to FIGS. 109-111, a light 137 inserted in the light holder clips 104 which is coupled to the light holder mount 141 is illustrated. FIG. 38 is a top view, FIG. 39 is a side view and FIG. 40 is a front view. The light holder clips 104 can be an integrated structure with the light holder mount 141. In this embodiment, the light has a cylindrical body with a light element such as a light emitting diode (LED) on one end. The light element can emit a beam that is aligned with the center axis length of the cylindrical body of the light.

Figure 112:
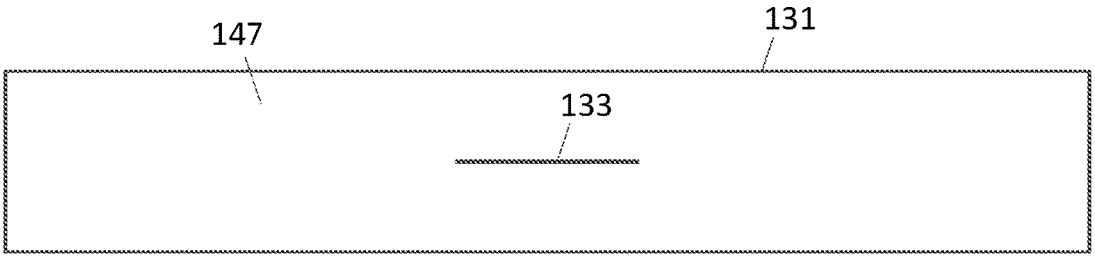
FIG. 112 illustrates a side view of an embodiment of an elastic belt.
Figure 113:
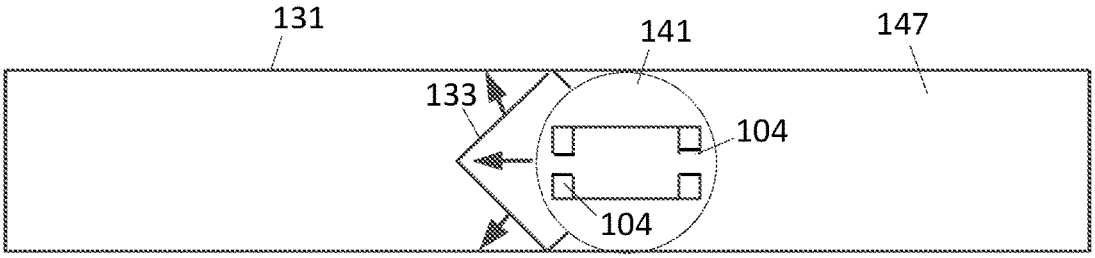
FIGS. 113-116 illustrates a side view of an embodiment of a light holder in a light holder mount placed into a pocket opening in an elastic belt.
Figure 114:
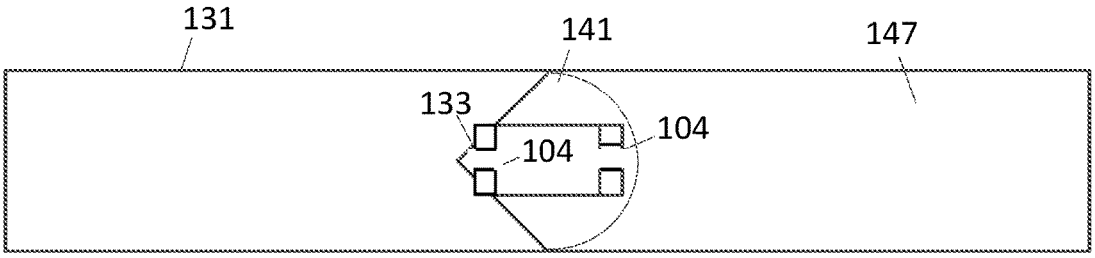
Figure 115:
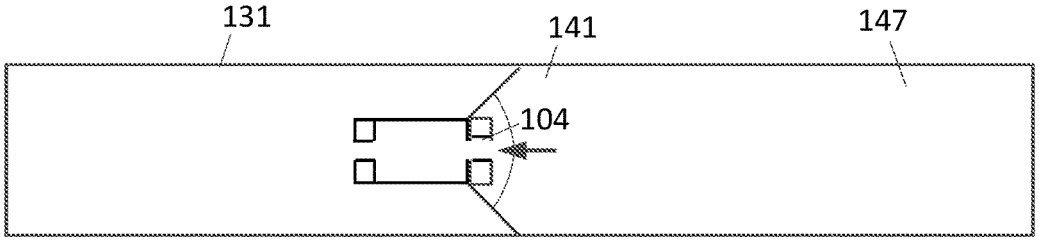
Figure 116:
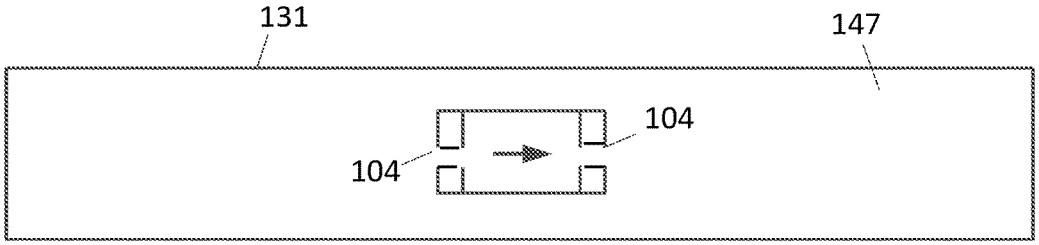

An embodiment of a method for installing the light holder and light holder mount 141 into the belt 131 is illustrated in FIGS. 112-117. With reference to FIG. 112, a side view of an elastic tubular belt 131 is illustrated. The outer layer 147 of a belt 131 can have a slot pocket 133 that is parallel to the upper and lower edges of the belt 131. With reference to FIG. 113, the slot pocket 133 is opened by widening the pocket 133 to a width that is greater than the width of the light holder mount 141. The width of the belt insert 141 can be equal to or slightly wider than the width of the tubular belt pocket. With reference to FIGS. 114 and 115, a first edge of the light holder mount 141 is slid into the slot pocket 133 with the pocket 133 stretched around the clips 104. With reference to FIG. 116, the entire light holder mount 141 has been placed into the belt 131. The light holder mount 141 is slid back in the opposite direction so that both clips 104 extend out of the slot pocket 133. The light holder mount 141 is held in a stable vertical position by the upper and lower edges of the internal belt pocket. The clips 104 are also held vertically and horizontally by the inner surfaces of the slot pocket 133. In other embodiments, the slot pocket 133 can be stretched around the perimeter of the belt insert 141 without having to remove the light from clip 104 into the slot pocket 133.

Figure 117:
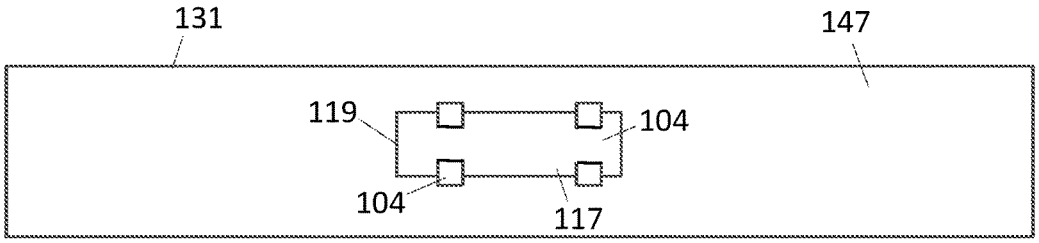
FIG. 117 illustrates a side view of an embodiment of a light placed in a light holder in a light holder mount placed into a pocket opening in an elastic belt.

With reference to FIG. 117, the light housing 107 is placed within the clips 104 with the light 119 facing forward from the belt 131. A light beam emitted by the light 119 can be tangential to the perimeter of the belt 131. The described process can result in a light 119 being attached to one side of the belt 131. It can be desirable to have two lights on opposite sides of the belt 131 as well.

Figure 118:
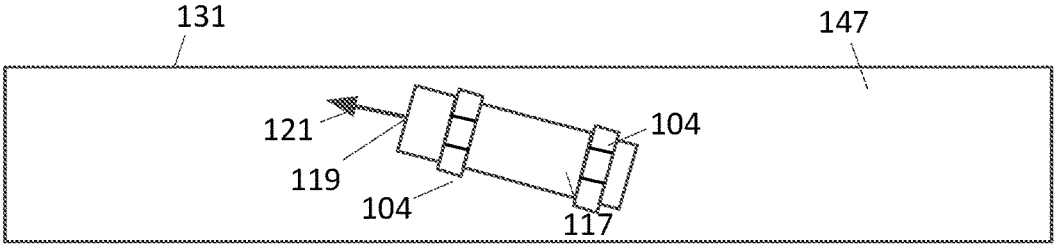
FIG. 118 illustrates a side view of an embodiment of a light rotated up in a light holder in a light holder mount placed into a pocket opening in an elastic belt.
Figure 119:
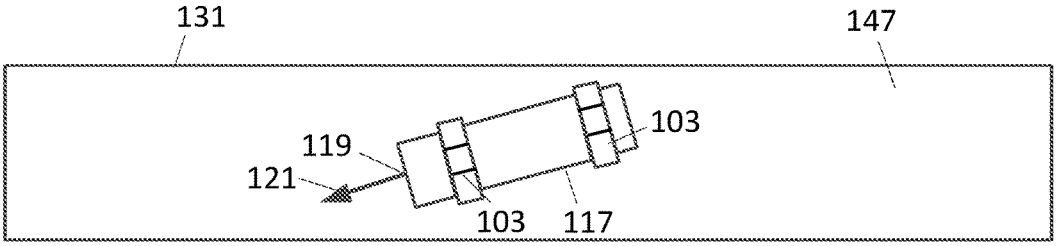
FIG. 119 illustrates a side view of an embodiment of a light rotated down in a light holder in a light holder mount placed into a pocket opening in an elastic belt.
Figure 120:
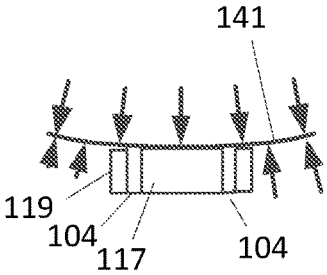
FIG. 120 illustrates a top view of an embodiment of a light in a light holder in an arched light holder mount.

Because the light holder mount 141 can be circular in shape, the light holder mount 141 can rotate within the tubular belt 131. With reference to FIG. 118 the light holder mount 141 is rotated so that the light beam 121 faces up and with reference to FIG. 119, the light holder mount 141 is rotated so that the light beam 121 faces down. With reference to FIG. 120, the light holder mount 141 can be compressed between the inner layer 145 and the outer layer 147 of the belt. More specifically, the user's waist may exert an outward force on the light holder mount 141 and the outer layer 147 may exert a compressive force inward against the light holder mount 141. The compression of the light holder mount 141 can help to hold the light holder mount 141 in place and hold the light 117 in a steady position on the belt 131. The light holder mount 141 can bend to match the curvature of the belt 131.

Figure 121:
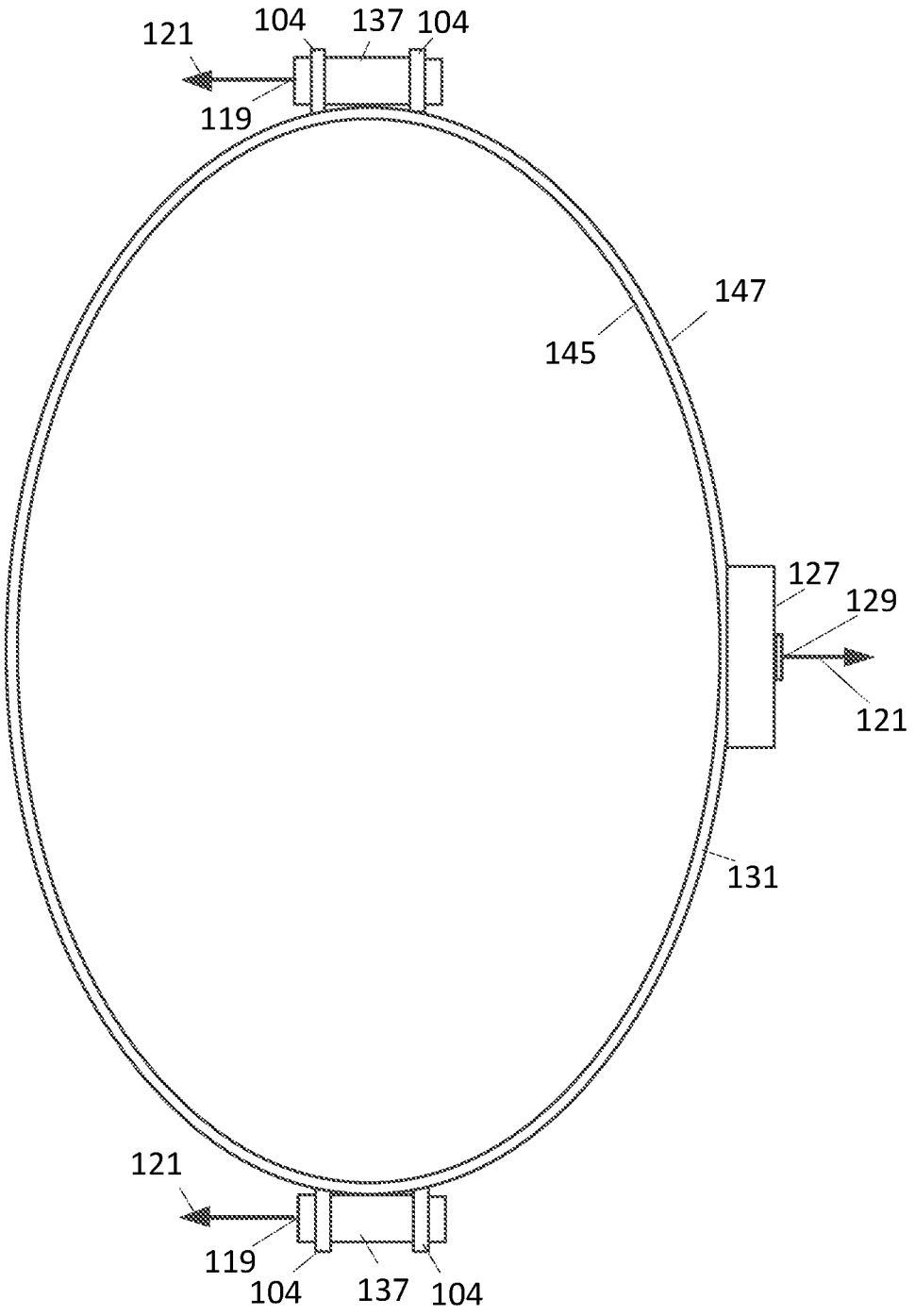
FIG. 121 illustrates a top view of an embodiment of an elastic belt with side and rear lights.

In an embodiment, with reference to FIG. 121, lights 137 can be mounted on opposite sides of the belt 131. In this example, both lights 137 are on opposite sides of the belt 131 and both lights 137 can emit light in a forward direction. Alternatively, as discussed, a user can rotate one light can face forward while the other light can be rotated to face backwards. In an embodiment a second rear light 129 is facing away from the rear of the belt 131. In this embodiment, the second rear light 129 can be attached to a battery pack 127 which can be used to power the lights on the belt 131.

Figure 122:
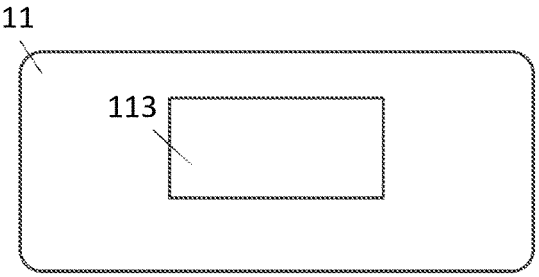
FIG. 122 illustrates a front view of an embodiment of a light holder mount.
Figure 123:
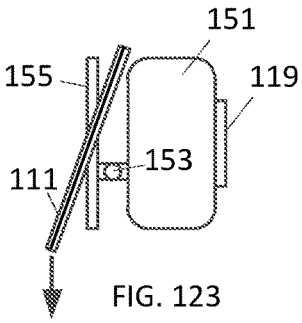
FIGS. 123-125 illustrate side views of an embodiment of a light holder mount placed on a light holder.
Figure 124:
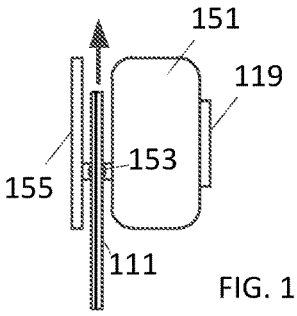
Figure 125:
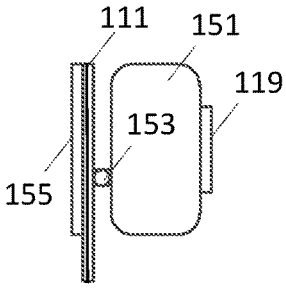

In some embodiments, a light and light housing can be attached to a hinge and a light holder plate. Thus, an elastic light holder is not used. With reference to FIG. 122, a light holder mount 111 can be rectangular in shape with a hole 113 that is offset from the center of the light holder mount 111. With reference to FIGS. 123-127, this light holder mount 111 can be used with a light housing 151 having a light 119 that can be attached to a hinge 153 and a light holder plate 155. With reference to FIG. 123, the plate 155 has been placed partially through the hole 113 in the light holder mount 111. With reference to FIG. 124, the plate 155 has been placed completely through the hole 113 in the light holder mount 111. With reference to FIG. 125, the plate 155 has been placed completely through the hole 113 and the light holder mount 111 is moved up so that the hinge 153 is adjacent to a lower edge of the hole 113.

Figure 126:
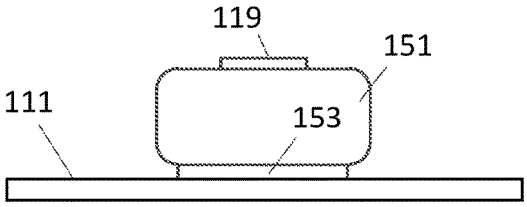
FIG. 126 illustrates a top view of an embodiment of a light holder mount placed on a light holder.
Figure 127:
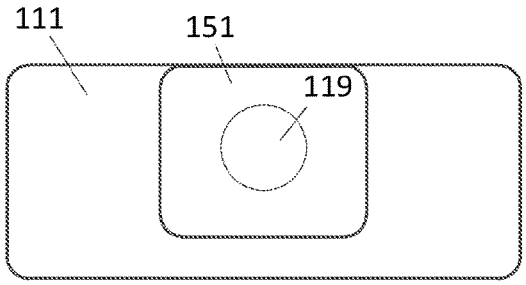
FIG. 127 illustrates a front view of an embodiment of a light holder mount placed on a light holder.

In an embodiment, the light holder mount 111 can be an integrated structure that is directly coupled to a hinge 153 attached to the light housing 151. FIG. 126 illustrates a top view and FIG. 127 illustrates a front view of the light housing 151 and light holder mount 111. The light holder mount 111 can have a width that is the same or slightly greater than the width of the tubular pocket within the belt 131. The light holder mount 111 can be inserted into the belt 131 in the same manner described above.

Figure 128:
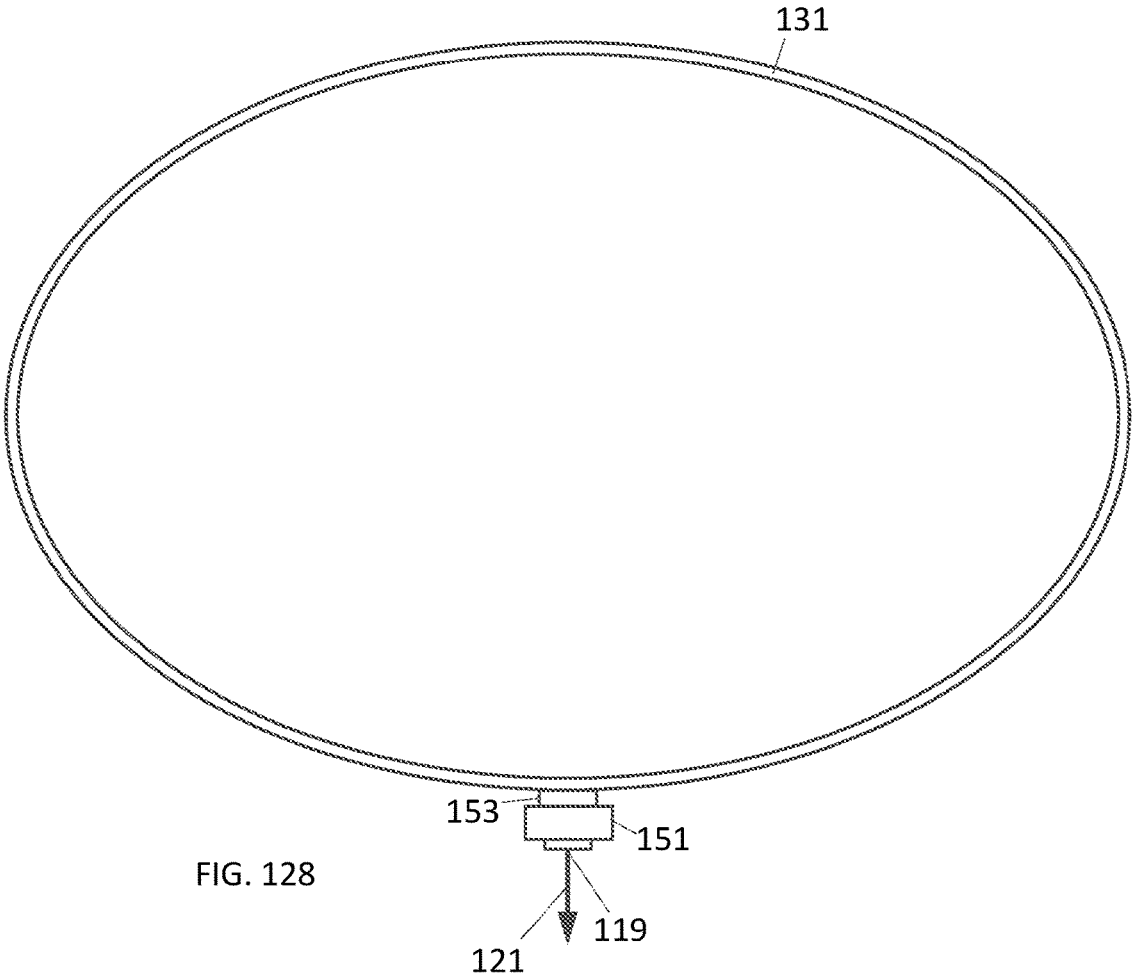
FIG. 128 illustrates a top view of an embodiment of a light attached to a holder mount placed in an elastic belt.
Figure 129:
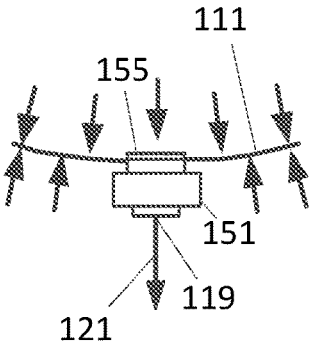
FIG. 129 illustrates a top view of an embodiment of a light attached to a arched holder mount.

A top view of the assembled light holder and belt insert is illustrated in FIG. 128. In this embodiment, the light 119 is facing away from the front of the belt 131. The belt 131 can be made with an inner layer and an outer layer forming a tubular structure. With reference to FIG. 129, the light holder mount 111 can be compressed between the inner layer and the outer layer of the belt 131. More specifically, the user's waist may exert an outward force on the light holder mount 111 and the outer layer may exert a compressive force inward against the light holder mount 111. The compression of the light holder mount 111 can help to hold the light holder mount 111 in place and hold the light 117 in a steady position on the belt 131. The light holder mount 111 can bend to match the curvature of the belt 131.

Figure 130:
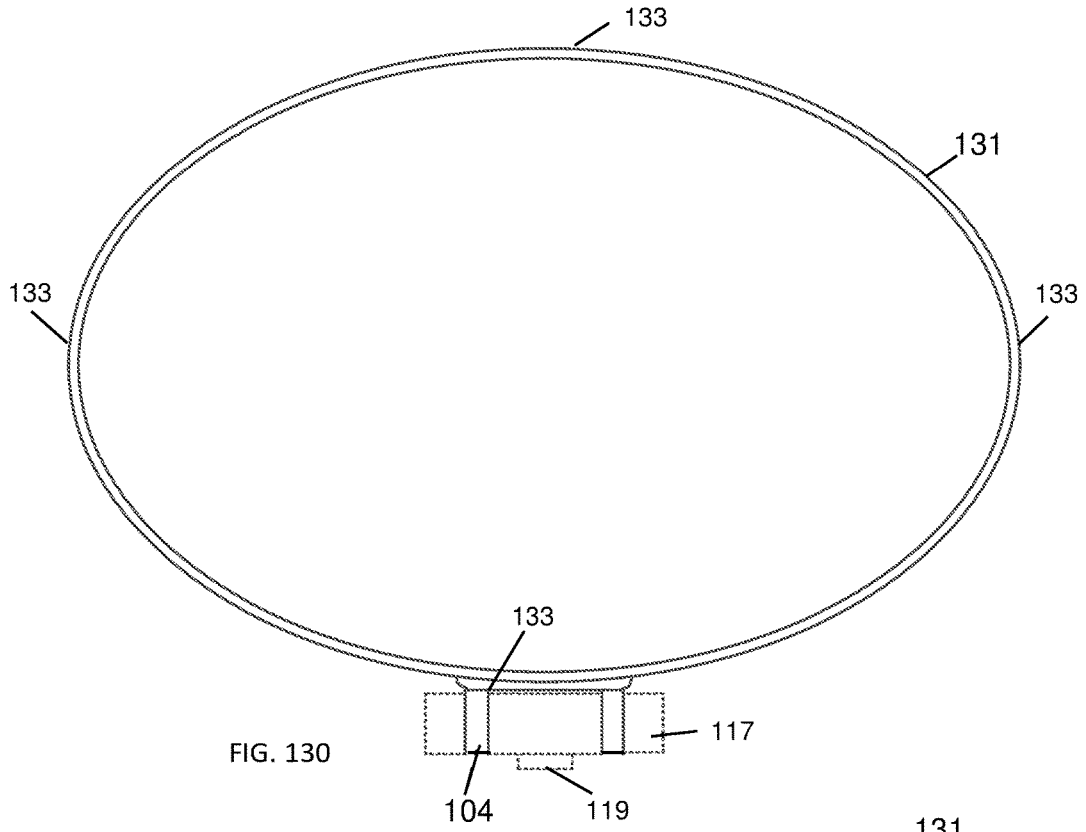
FIG. 130 illustrates a top view of an embodiment of a light holder in a pocket of an elastic belt.
Figure 131:
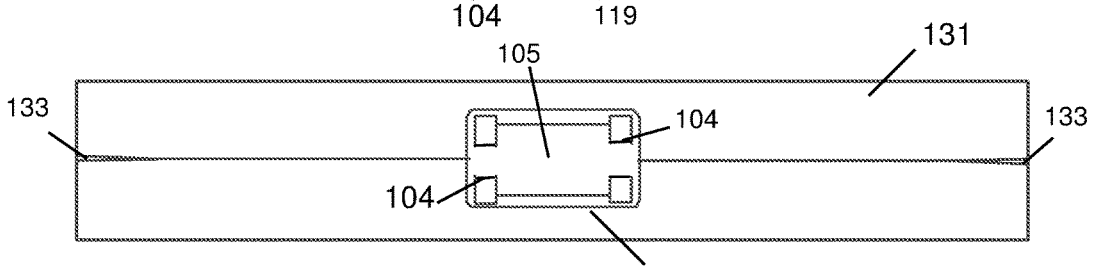
FIG. 131 illustrates a front view of an embodiment of a light holder in a pocket of an elastic belt.
Figure 132:
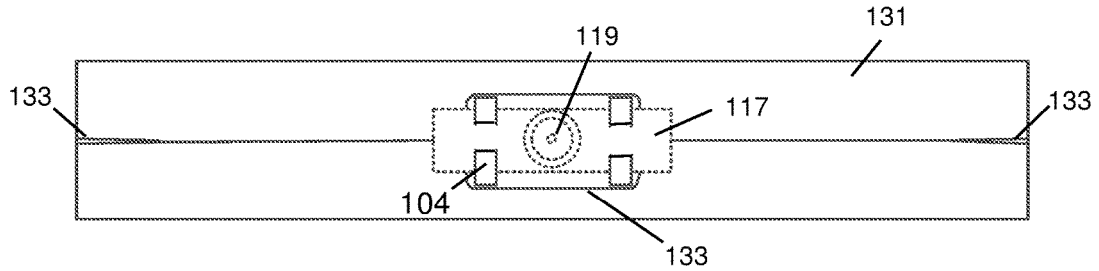
FIG. 132 illustrates a front view of an embodiment of a light in a light holder in a pocket of an elastic belt.
Figure 133:
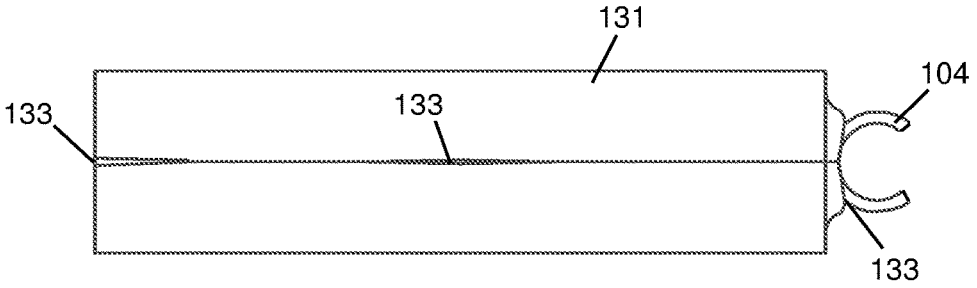
FIG. 133 illustrates a side view of an embodiment of a light holder in a pocket of an elastic belt.
Figure 134:
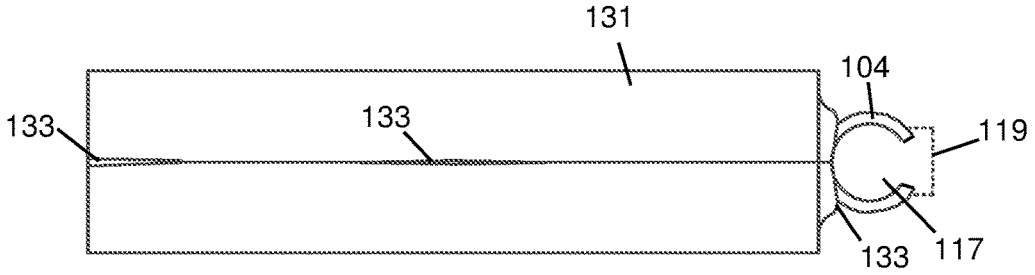
FIG. 134 illustrates a side view of an embodiment of a light in a light holder in a pocket of an elastic belt.

FIGS. 130-135 illustrate different view of an embodiment of a light holder in a light holder mount held in a tubular belt having multiple slot pockets around the perimeter of the belt with the slot pockets positioned in the middle section of the width of the belt. FIG. 130 illustrates a top view of a belt 131 having a light holder with clips 104 extending outward from a pocket 133 of the belt 131. A light housing 117 can be placed through the clips 104 with a light 119 facing outward from the belt 131. FIG. 131 illustrates a front view of the belt 131 with the clips 104 and the base 105 of the light holder visible through the expanded front pocket 133. FIG. 132 illustrates a front view of the belt 131 with the clips 104 and the base 105 of the light housing 117 positioned through the clips 104 and the light 119 facing forward. The elastic belt 131 can be worn around the waist or hips of a user. The angle of the light 119 can be adjusted by rotating the light housing 117 within the clips 104. FIG. 62 illustrates a side view of a belt 131 with the clips 104 of the light holder extending from the front pocket 133. FIG. 134 illustrates a side view of a belt 131 with a light housing 117 placed in the clips 104 of the light holder extending from the front pocket 133 and the light 119 facing forward.

While the embodiments described above are directed towards belt inserts coupled to light holders that are inserted through horizontal slot openings in an outer layer, in other embodiments, the present invention can be used with belts that have overlapping pockets. In these embodiments, the tubular belt may include an inner layer, a lower outer layer that is coupled to the lower edge of the inner layer and an upper outer layer that is coupled to the upper edge of the inner layer. The upper outer layer may overlap with the lower outer layer. In these embodiments, the belt insert shown in FIGS. 5-7 can be placed in the belt by lifting the upper outer layer and inserting the lower edge of the belt insert 111 between the lower outer layer and the inner layer. The upper outer layer can then be secured over the upper edge of the belt insert 111. The inward compress of the upper outer layer and the lower outer layer can hold the belt insert 111 in place and the light housings can be coupled to the clips 104 in the light holder 101 as described above.

Figure 135:
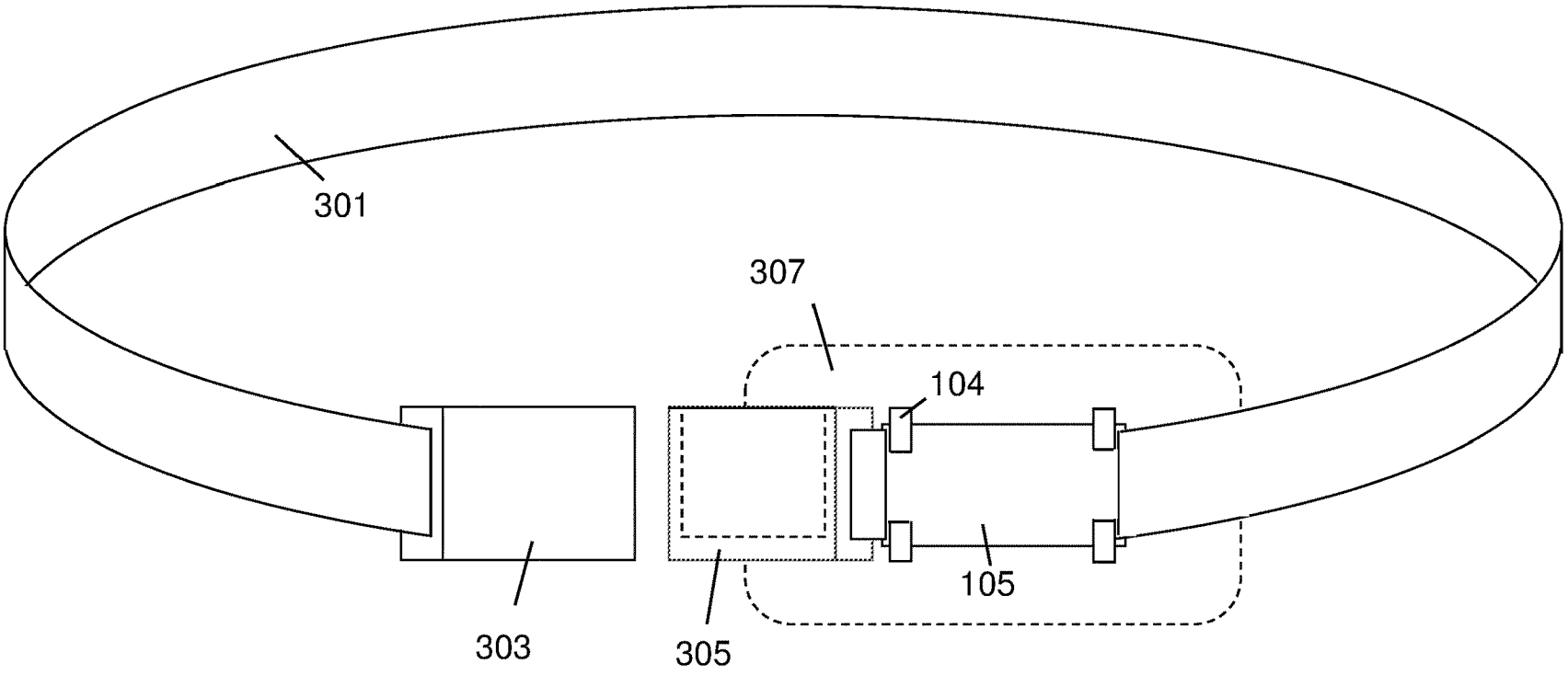
FIG. 135 illustrates a perspective front view of a belt with an light holder attachment and a disconnected buckle.
Figure 136:
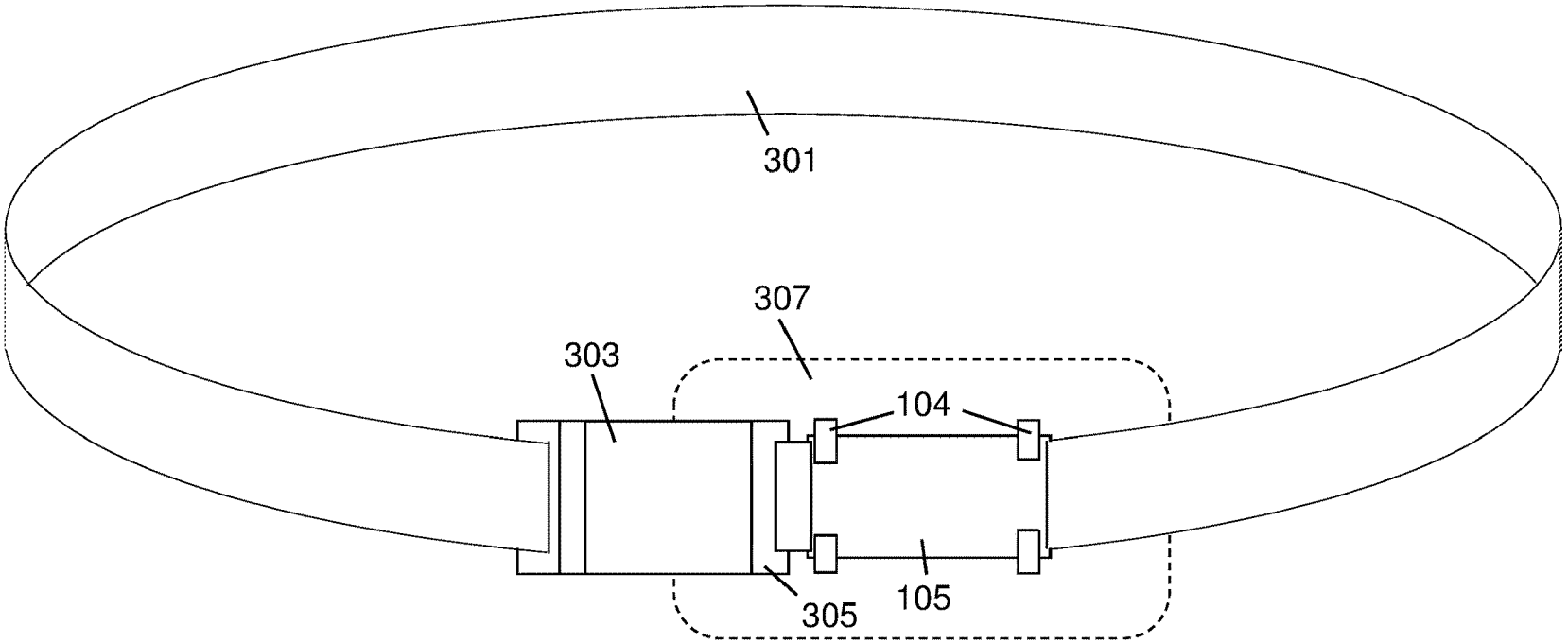
FIG. 136 is a perspective front view of a belt with an light holder attachment and a connected buckle.

With reference to FIGS. 135 and 136, a perspective front view of an embodiment of a waist mounted light holder apparatus is illustrated. The light holder can include clips 104 that are attached to a base 105 and may be perpendicular to the base 105. The base 105 can be attached to or integrated with a stabilizer structure 307 which can be a thin flexible structure that can bend in an arch but may not stretch in length or width.

The light holder apparatus can include a belt 301 which can be an elastic strap which can be adjustable in length and may not have any pockets. The ends of the belt 301 can be coupled to a first buckle piece 303 and a second buckle piece 305. The first buckle piece 303 and the second buckle piece 305 can be releasably coupled to each other. In an embodiment, the first buckle piece 303 and the second buckle piece 305 can include a magnet to assist in connecting the first buckle piece 303 and the second buckle piece 305.

Figure 137:
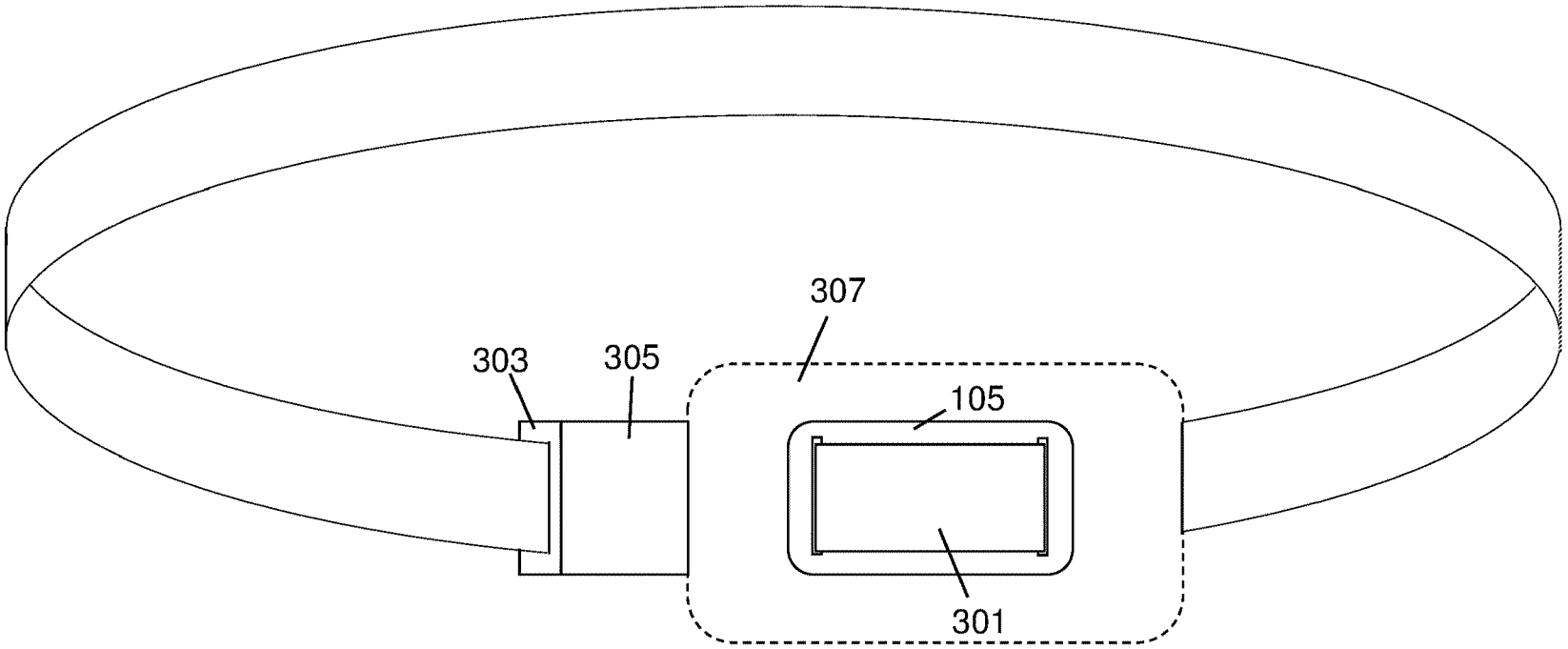
FIG. 137 is a perspective rear view of a belt with an light holder attachment and a connected buckle.
Figure 138:
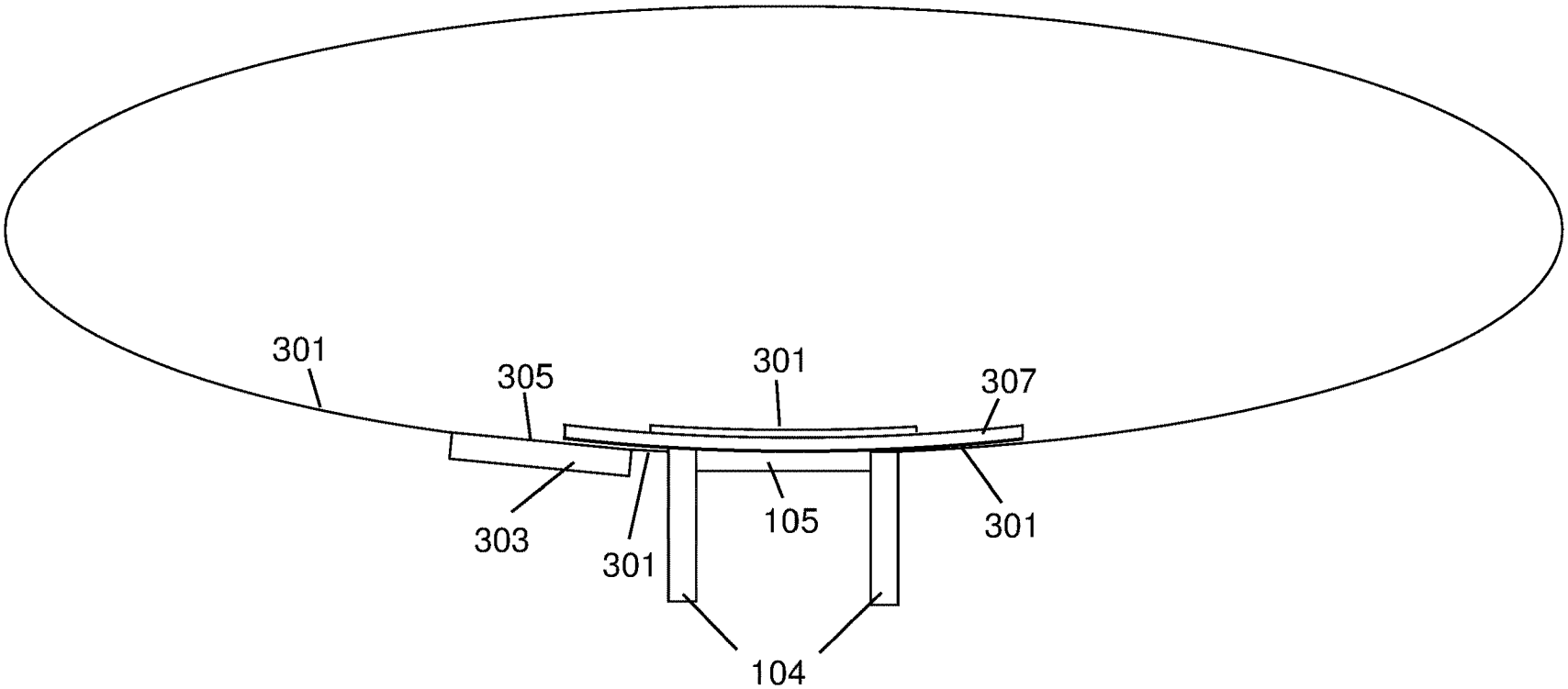
FIG. 138 is a top view of a belt with an light holder attachment and a disconnected buckle.

FIG. 137 is a rear view and FIG. 67 is a top view of an embodiment of a waist mounted light holder apparatus. In this example, the strap 301 is fed through slots in the base 105. Thus, the strap 301 is on a front portion of the stabilizer structure 307 on the sides and the strap 301 is rear portion of the base 105 in the center portion. In an embodiment, the base 105 and the stabilizer 307 can be a single integrated structure and the strap 301 can be adjacent to a front portion of the stabilizer 307 portion of the integrated structure on the sides and adjacent to a real portion of the base 105 portion of the integrated structure on the center.

Figure 139:
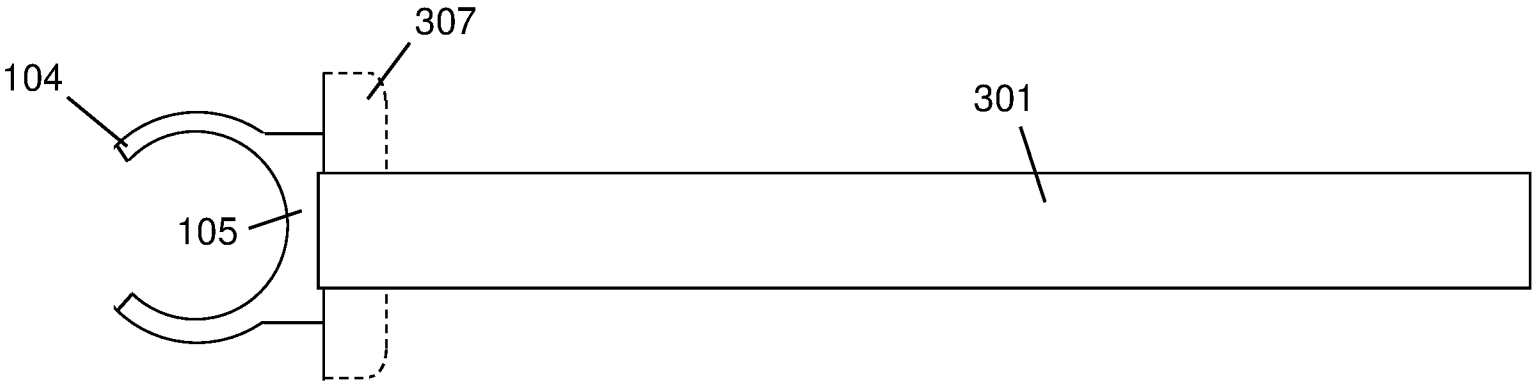
FIG. 139 is a side view of a belt with an light holder attachment.
Figure 140:
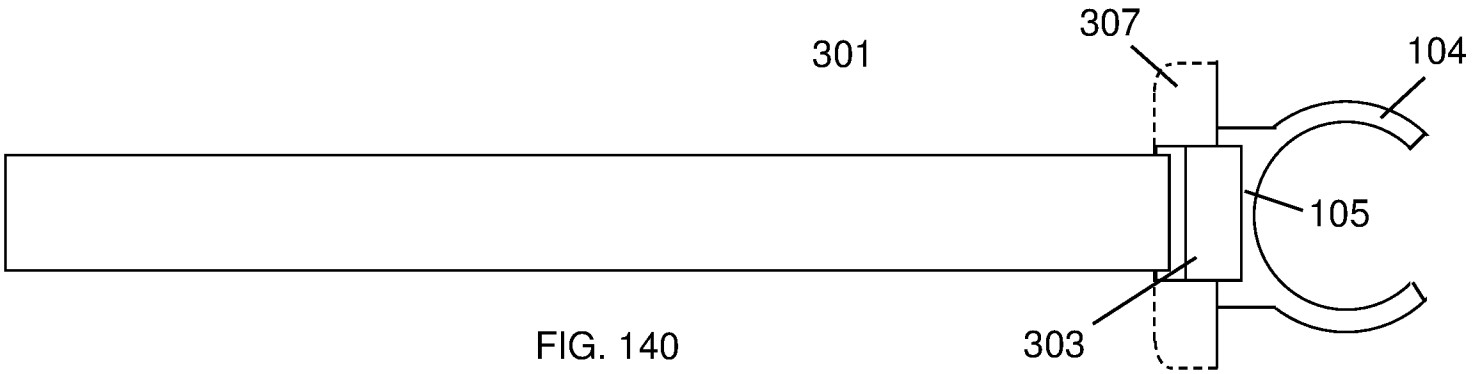
FIG. 140 is a side view of a belt with an light holder attachment.

FIG. 139 is a left side view and FIG. 140 is a right side view of an embodiment of a waist mounted light holder apparatus. The clips 104 can be made of a strong elastic material and can have a circular inner surfaces which can hold a cylindrical body light apparatus. The clips 104 can also allow the cylindrical body light apparatus to rotate so the light beam can be adjusted. The clips 104 can be made of an elastic plastic material so that the light can be pressed through the open portions of the clips 104 expand outward so the light can be inserted or removed from the clips 104. The inner diameter of the clips 104 can be slightly smaller than the outer diameter of the light so that the clips 104 are slightly expanded outward when the light is in the clips 104.

When worn around the waist of a user, the stabilizer 307 can be pressed or compressed against the abdomen of the user by the strap 301. The stabilizer 307 can prevent the light from bouncing by providing a surface that can resist rotation of the light relative to the belt 301 when the user is running or jumping.

In the illustrated embodiment the stabilizer 307 can be similar or identical in construction as the light holder mount which is reference number 111 illustrated above. The stabilizer 307 can have a plastic layer and an inner foam layer and an outer foam layer. In an embodiment the plastic layer can be 0.005-0.050 inch thick polycarbonate or any other suitable plastic material and the foam can be 0.050-0.200 inch thick ethylene vinyl acetate (EVA) foam or any other suitable plastic material. The inner foam layer and outer foam layer can be attached to the plastic layer with an adhesive. The inner surfaces of a center hole can surround the base 105 of the light holder. In other embodiments, the clips 104, the base 105 and stabilizer 307 can be a single integrated structure which can be made of an elastic plastic material. The clips 104 can bend to allow the light to be inserted and removed. The stabilizer 307 can bend to conform to the curvature of the user's abdomen.

Figure 141:
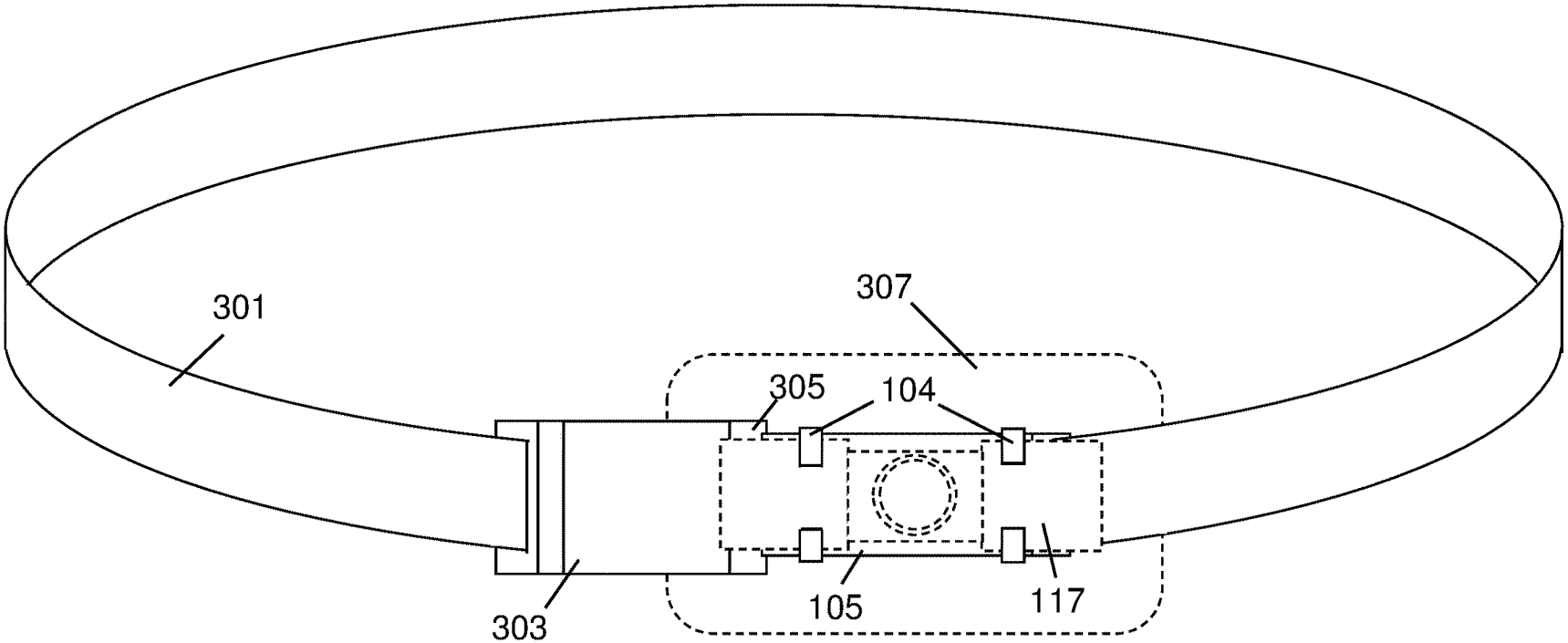
Figure 142:
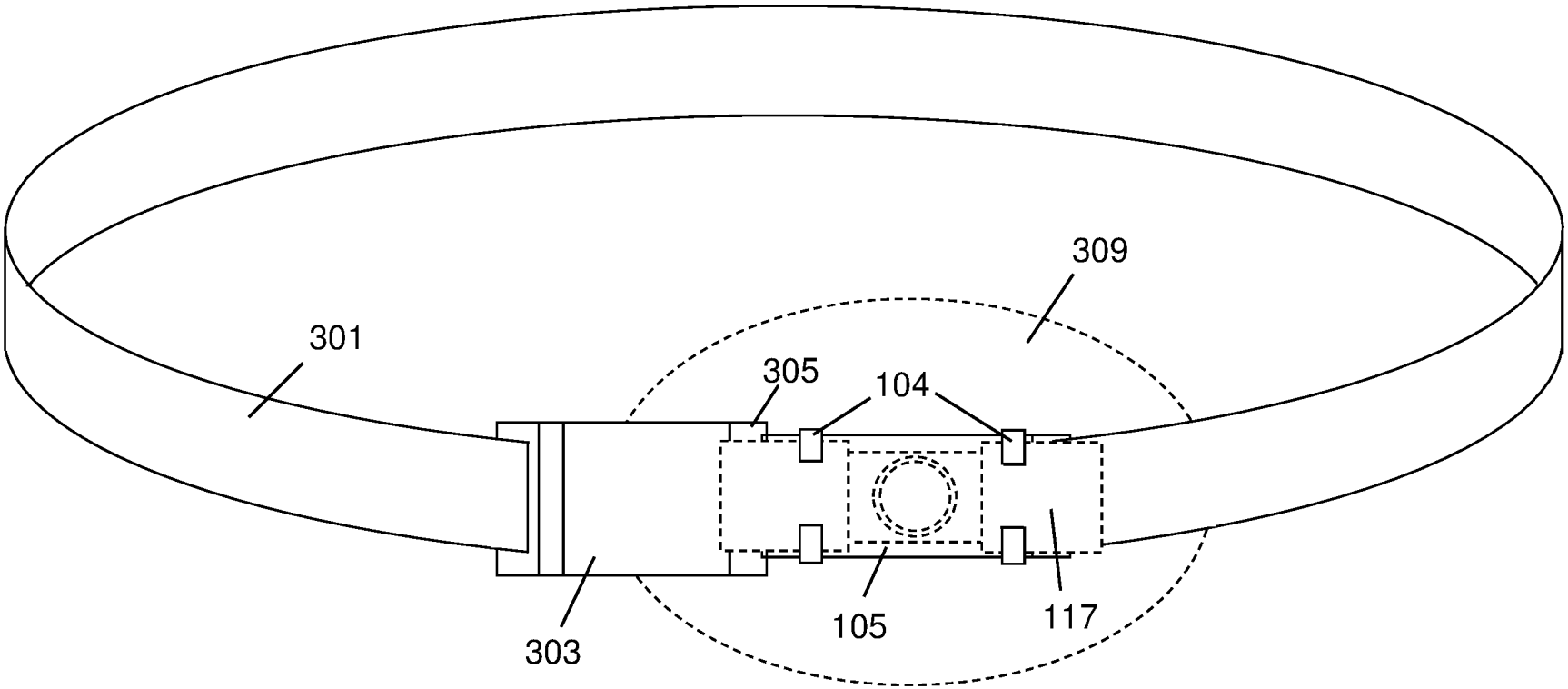

In different embodiments, the stabilizer used with the light holder can have different perimeter shapes. FIG. 141 illustrates an embodiment of the light holder which has a rectangular stabilizer 307. FIG. 142 illustrates an embodiment of the light holder which has an oval stabilizer 309.

The present disclosure, in various embodiments, includes components, methods, processes, systems and/or apparatus substantially as depicted and described herein, including various embodiments, subcombinations, and subsets thereof. Those of skill in the art will understand how to make and use the present disclosure after understanding the present disclosure. The present disclosure, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation. Rather, as the following claims reflect, inventive aspects lie in less than all features of any single foregoing disclosed embodiment.

What is claimed is:

1. An apparatus comprising:

an elastic belt having an inner layer, an outer layer, a pocket opening in the outer surface, and a pocket space between the inner layer and the outer layer, wherein the pocket opening is a linear slot in a closed position that is parallel with the upper edge and the lower edge of the elastic belt, an upper edge of the inner layer is physically coupled to an upper edge of the outer layer and a lower edge of the inner layer is physically coupled to a lower edge of the outer layer;

a light holder having a base coupled to a first elastic clip or a first loop and a second elastic loop or a second loop, a light holder mount coupled to the light holder wherein the light holder mount and the base of the light holder are in the pocket space of the elastic belt and the first elastic clip or the first loop and the second elastic loop or the second loop extend through the pocket opening in the outer layer of the elastic belt; and a battery powered light having a housing that is held by the first elastic clip or the first loop and the second elastic clip or the second loop.

2. The apparatus of claim 1 wherein the light holder mount has an upper edge that is adjacent to the upper edge to the inner layer and a lower edge that is adjacent to the lower edge of the inner layer.

3. The apparatus of claim 1 wherein a perimeter of the light holder mount is rectangular in shape.

4. The apparatus of claim 1 wherein a perimeter of the light holder, the first loop, and the second loop are integrated into a single structure.

5. The apparatus of claim 1 wherein the light holder mount has an inelastic plastic layer.

6. The apparatus of claim 1 wherein the light holder mount has an inner foam layer attached to an inelastic plastic layer and an outer foam layer attached to the plastic layer.

7. The apparatus of claim 1 wherein the light holder mount has a rectangular hole and a portion of the light holder is within the rectangular hole.

8. The apparatus of claim 1 wherein the rectangular hole is located at a geometric center portion of the light holder mount.

9. The apparatus of claim 1 wherein the light holder mount has a rectangular hole that surrounds the base of the light holder, the first elastic clip and the second elastic clip are on an outer layer of the elastic belt.

10. The apparatus of claim 9 wherein a flange is attached to the base of the light holder, the flange is on an inner side of the light holder mount, and a perimeter of the flange is larger than the rectangular hole in the light holder mount.

11. An apparatus comprising:

an elastic belt having an inner layer, an outer layer, a pocket opening in the outer surface, and a pocket space between the inner layer and the outer layer, wherein the pocket opening is a linear slot in a closed position that is parallel with the upper edge and the lower edge of the elastic belt, an upper edge of the inner layer is physically coupled to an upper edge of the outer layer and a lower edge of the inner layer is physically coupled to a lower edge of the outer layer; and an integrated structure having a light holder portion and a light holder mount portion, the light holder portion having a first inner diameter which at least partially surrounds a light housing and a second inner diameter which at least partially surrounds the light housing, wherein the light holder mount portion is in the pocket space of the elastic belt and the first inner diameter and the second inner diameter extend out of the pocket opening in the outer layer of the elastic belt.

12. The apparatus of claim 11 wherein the light holder portion has an upper edge that is adjacent to the upper edge to the inner layer and a lower edge that is adjacent to the lower edge of the inner layer.

13. The apparatus of claim 11 wherein a perimeter of the light holder portion is rectangular in shape.

14. The apparatus of claim 11 wherein the light holder portion is located at a geometric center portion of the light holder mount portion.

15. An apparatus comprising:

an elastic belt having an inner layer, an outer layer, a pocket opening in the outer surface, and a pocket space between the inner layer and the outer layer, wherein the pocket opening is a linear slot in a closed position that is parallel with the upper edge and the lower edge of the elastic belt, an upper edge of the inner layer is physically coupled to an upper edge of the outer layer and a lower edge of the inner layer is physically coupled to a lower edge of the outer layer;

a light holder having a first inner diameter which at least partially surrounds a light housing and a second inner diameter which at least partially surrounds the light housing; and a light holder mount coupled to the light holder wherein the light holder mount is in the pocket space of the elastic belt and the first inner diameter and the second inner diameter extend out of the pocket opening in the outer layer of the elastic belt.

16. The apparatus of claim 15 wherein the light holder portion is an integrated single structure.

17. The apparatus of claim 15 wherein the light holder has an inelastic plastic layer.

18. The apparatus of claim 15 wherein the light holder mount has an inner foam layer attached to an inelastic plastic layer and an outer foam layer attached to the plastic layer.

19. The apparatus of claim 15 wherein the light holder mount has a rectangular hole that surrounds a portion of the light holder.

20. The apparatus of claim 19 wherein the rectangular hole is located at a geometric center of the light holder mount.

* * * * *